US006379085B1

(12) United States Patent
Vanderklaauw

(10) Patent No.: US 6,379,085 B1
(45) Date of Patent: Apr. 30, 2002

(54) METHOD AND APPARATUS FOR RELOCATING A STRUCTURE FROM A FIRST ELEVATION TO A SECOND ELEVATION

(76) Inventor: Peter M. Vanderklaauw, 8360 SW. 186th St., Miami, FL (US) 33157

( * ) Notice: Subject to any disclaimer, the term of this patent is extended or adjusted under 35 U.S.C. 154(b) by 0 days.

(21) Appl. No.: 09/435,855

(22) Filed: Nov. 8, 1999

Related U.S. Application Data

(63) Continuation-in-part of application No. 08/972,454, filed on Nov. 18, 1997, now Pat. No. 5,980,160.

(60) Provisional application No. 60/038,633, filed on Feb. 19, 1997.

(51) Int. Cl.[7] ..... E02G 23/00; E02D 35/00; E04B 1/02; E04B 1/18

(52) U.S. Cl. ..... 405/230; 52/651.01; 52/127.1; 248/354.1; 405/229; 405/288

(58) Field of Search ..... 405/230, 229, 405/288, 196–199; 52/592.6, 651.01, 651.05, 646, 127.1; 182/128, 187, 152, 178.1, 178.3, 178.5, 178.6; 254/93, 96, 98, 106; 248/343, 354.1

(56) References Cited

U.S. PATENT DOCUMENTS

| | | | | |
|---|---|---|---|---|
| 1,279,901 A | * | 9/1918 | Phelps | 405/230 X |
| 1,418,510 A | | 6/1922 | Alexander | 52/745.2 |
| 2,722,040 A | | 11/1955 | Ludowici | 52/741.15 |

(List continued on next page.)

*Primary Examiner*—Thomas B. Will
*Assistant Examiner*—Tara L. Mayo
(74) *Attorney, Agent, or Firm*—Jones, Tullar & Cooper,PC

(57) ABSTRACT

A method and apparatus are provided for elevating a house, building, or other structure. The apparatus of the system includes a plurality of beam elements. The beam elements include a space-frame structure and include mateable ends whereby a first beam element may be connected to a second beam element in an end-to-end fashion for forming an elongate unitary consolidated beam. Thus, any number of beam elements may be connected to one-another for forming a consolidated beam of any desired length. The beam elements are provided in several lengths, and are light enough so that one or two individuals may lift and carry the beam elements by hand for installation in a structure and removal from a structure. The system may further include additional equipment to enable use of the system without the necessity of significantly damaging the exterior walls of the structure. A plurality of consolidated beams are constructed within a structure's interior and fastened to the structure for forming a lifting grid. A lifting system may be placed in structural communication with the lifting grid for use in elevating the structure. The lifting system may include a plurality of releasably connectable generally U-shaped building elements which are connected together to form slotted lifting posts. Hydraulic cylinders may be mounted within the slots of the lifting posts for lifting the lifting grid, and thereby elevating the structure. The structure may be elevated progressively to practically any height by adding additional building elements to the lifting posts in the space created by extension of the hydraulic cylinders, and then relocating the cylinders within the posts to further elevate the structure.

19 Claims, 23 Drawing Sheets

U.S. PATENT DOCUMENTS 2,742,260 A * 4/1956 Patterson ..... 52/651.15 X
3,028,142 A * 4/1962 Friesen ..... 248/354.1 X
3,273,859 A 9/1966 Walli ..... 254/109
3,347,002 A * 10/1967 Penkuhn ..... 405/230 X
3,679,177 A 7/1972 Scholz ..... 254/89 R
3,685,301 A * 8/1972 Heacox ..... 405/230
3,692,446 A 9/1972 Vanderklaauw ..... 425/63
3,742,662 A * 7/1973 Ballou ..... 52/651.01 L X
3,747,689 A * 7/1973 Frederick ..... 182/178.1 X
3,828,513 A 8/1974 Vanderklaauw ..... 52/745.04
3,831,902 A 8/1974 Vanderklaauw ..... 254/105
3,884,494 A 5/1975 Ashby et al. ..... 280/442
3,920,780 A 11/1975 Vanderklaaw ..... 264/33
4,011,705 A 3/1977 Vanderklaaw ..... 52/745.68
4,070,867 A * 1/1978 Cassidy ..... 405/230 X
4,206,162 A 6/1980 Vanderklaauw ..... 264/33
4,251,974 A 2/1981 Vanderklaauw ..... 52/745.2
4,262,773 A * 4/1981 Basham ..... 182/178.5 X
RE30,876 E 3/1982 Caisley ..... 254/106
4,634,319 A * 1/1987 May ..... 405/230
4,832,315 A 5/1989 Vanderklaauw ..... 254/89 H
4,980,999 A 1/1991 Terenzoni ..... 52/125.6
5,004,375 A * 4/1991 Lee ..... 405/230
5,246,311 A 9/1993 West et al. ..... 405/230
5,292,098 A * 3/1994 Worthington ..... 248/354.1
5,413,303 A * 5/1995 Lee ..... 248/354.1
5,575,591 A 11/1996 Vanderklaauw ..... 405/230
5,724,781 A 3/1998 Matthias et al. ..... 52/741.11

* cited by examiner

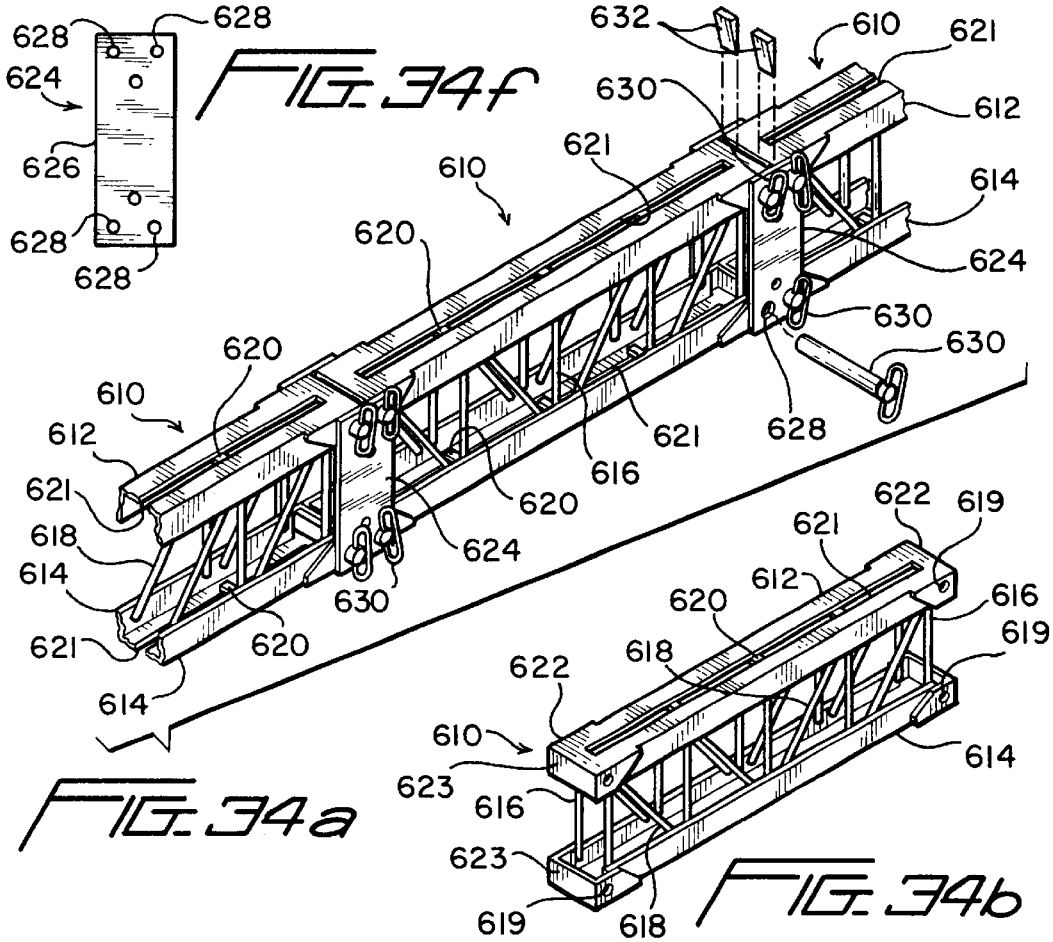
FIG. 34f
FIG. 34a
FIG. 34b
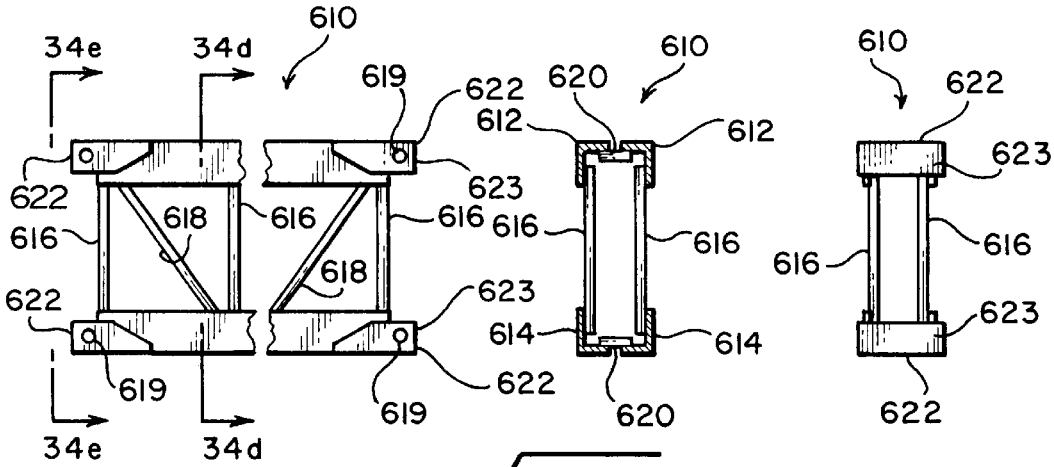
FIG. 34d
FIG. 34c
FIG. 34e

FIG. 39
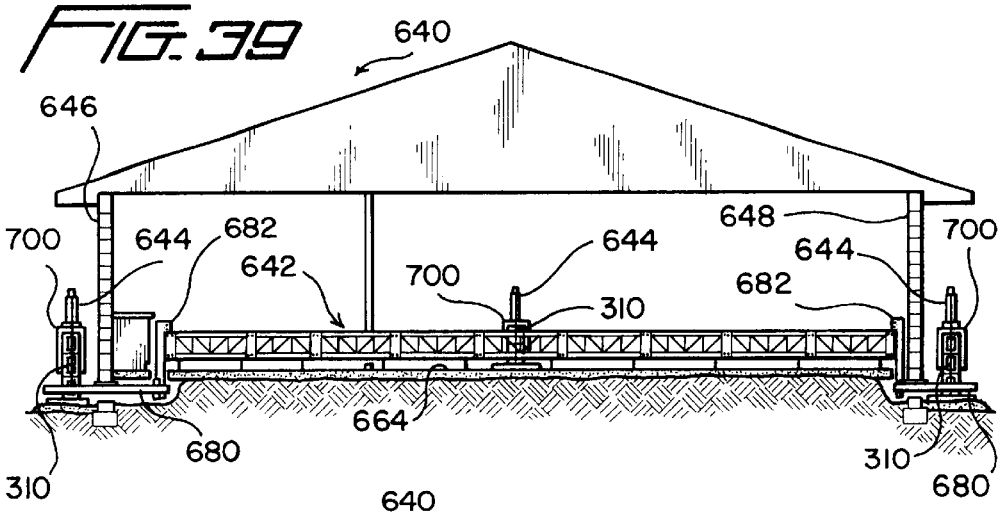
FIG. 40
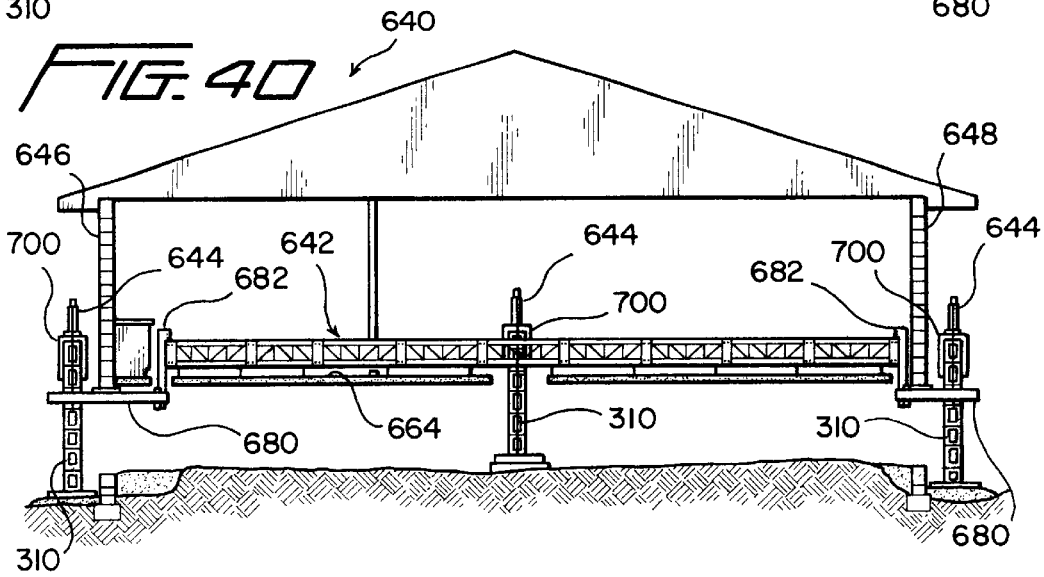
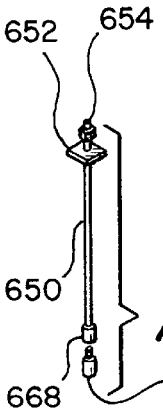
FIG. 43
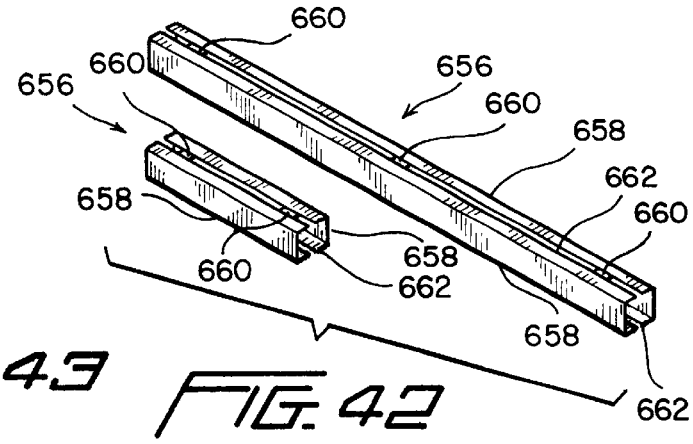
FIG. 42

FIG. 49
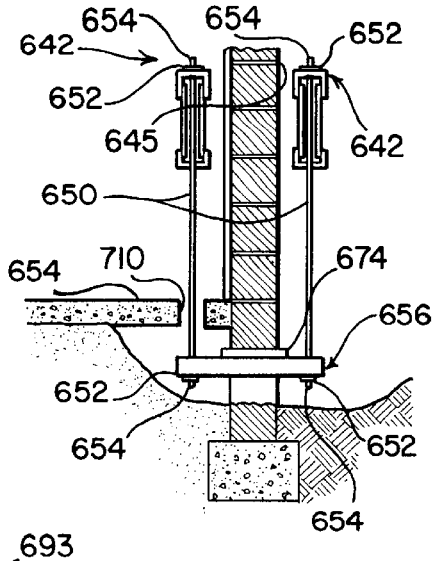
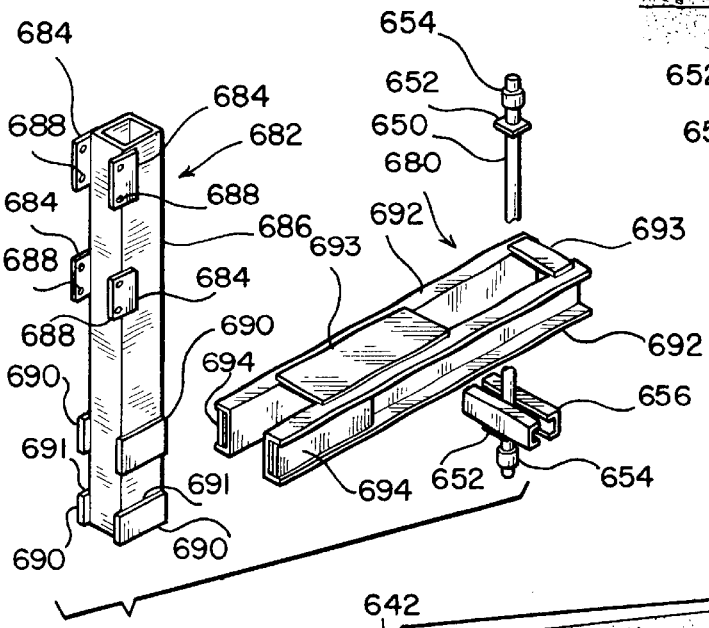
FIG. 46
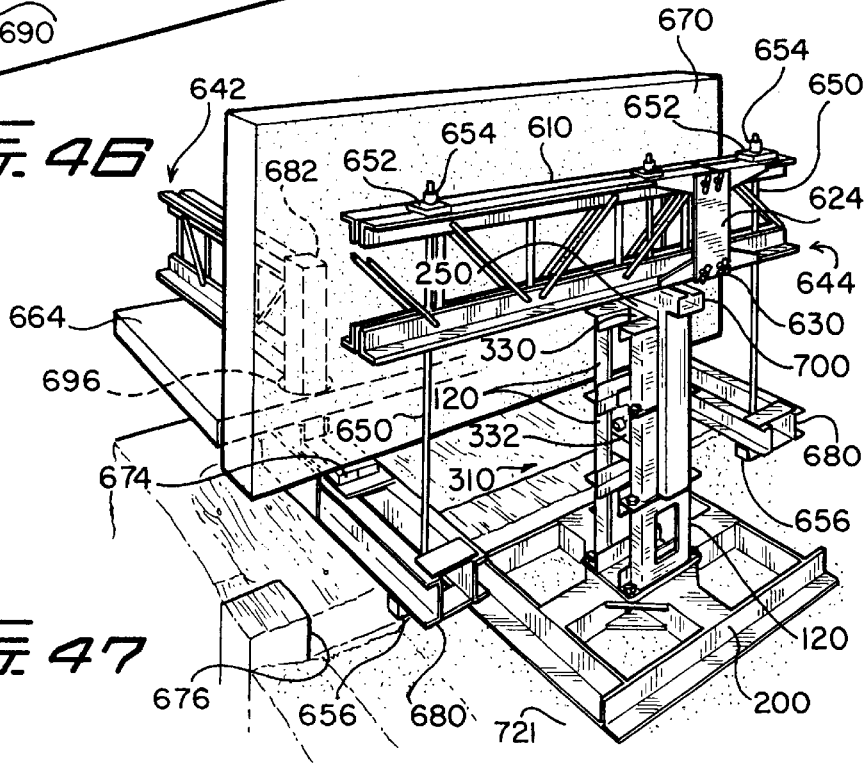
FIG. 47

FIG. 57a
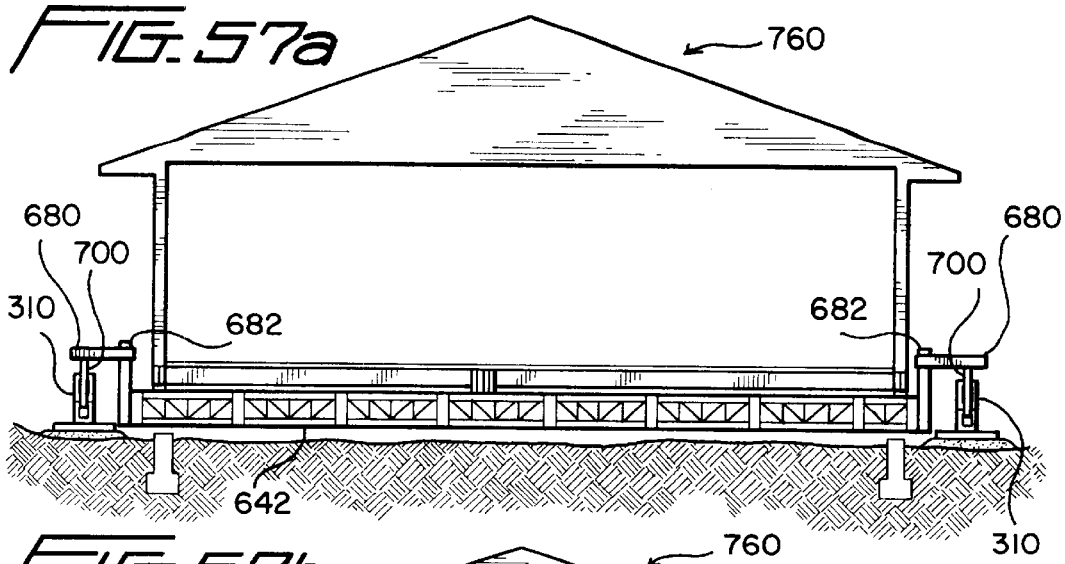
FIG. 57b
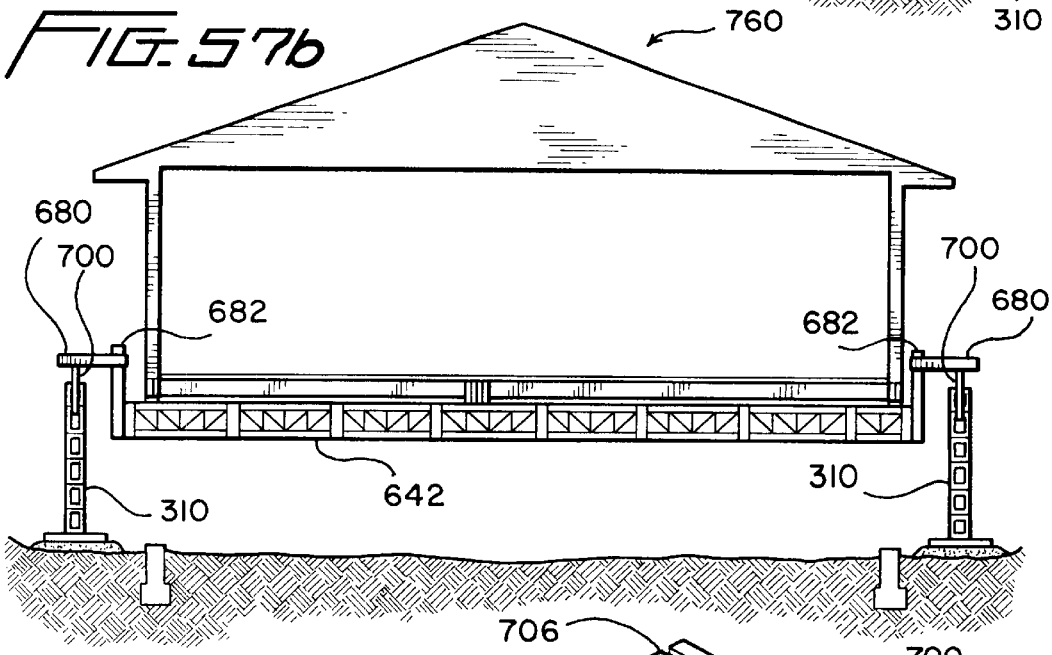
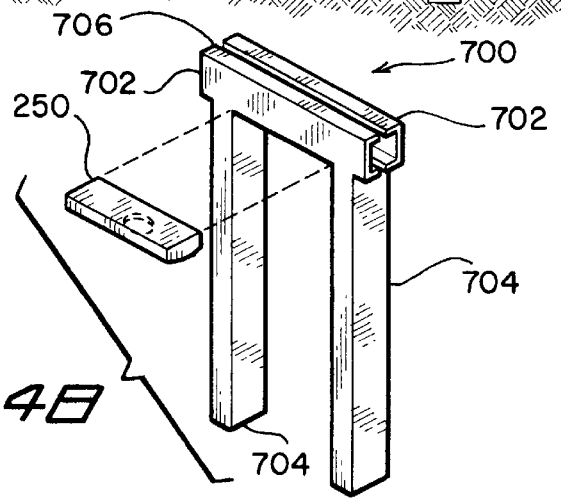
FIG. 48

METHOD AND APPARATUS FOR RELOCATING A STRUCTURE FROM A FIRST ELEVATION TO A SECOND ELEVATION

CROSS-REFERENCE TO RELATED APPLICATIONS

This application is a continuation-in-part of U.S. patent application No. 08/972,454, filed on Nov. 18, 1997, now U.S. Pat. No. 5,980,160, and which application claims the benefit of U.S. Provisional application No. 60/038,633, filed on Feb. 19, 1997.

BACKGROUND OF THE INVENTION

1. Field of the Invention

The present invention generally relates to a method and apparatus for elevating houses, buildings, and other large structures. More particularly, this invention relates to a modular support and lifting system which includes a plurality of support elements, building elements, lifting elements, and accessories which may be combined and installed to raise or lower a structure from one elevation to another.

2. Description of the Prior Art

During the past half century, areas of land near bodies of water have become increasingly populated with houses and other developments. Recently, however, flooding in many low-lying areas of the country has caused tremendous property damage. This has prompted serious attention from the government and the media to seek solutions to the problem.

One such solution comprises elevating houses, buildings, and other structures located near rivers, deltas, lakes, and coastal areas. Under this solution, the existing houses, etc., are detached from their foundations and elevated to a height above flood levels. New supporting structure is then built underneath the elevated house to maintain the house at the new height. This technique raises the living areas of the house sufficiently so that the portions of the house containing the most valuable furnishings and the like remain dry and undamaged during flood conditions. This greatly minimizes any property damage and associated losses due to flooding.

If the houses or other structures are constructed of wood, then raising the house off the ground and adding supporting pylons, walls, or other additional supporting structure underneath the house is fairly routine because wood houses are relatively light, and are usually already elevated somewhat above the ground. However, a large number of houses in flood-prone areas are constructed of masonry, concrete blocks, or the like, and/or are built upon concrete slabs in what is commonly known as slab-on-grade construction. To raise one of these houses is much more involved, and requires considerable experience and expertise.

The conventional method for raising a house having a concrete slab foundation is to excavate the soil from underneath the house and then jack up the house from the excavated space. However, excavation is not always desirable since it is expensive and can destroy landscaping. Also, excavation is not always possible, as in the case of the ground-water table being too high, the ground being too rocky, or otherwise not enabling of excavation.

To avoid the requirement of excavation, it is known in the art to install a plurality of steel beams in the structure of the house by passing the beams through the walls of the house above the slab, extending the beams through the interior of the house and out the other side. The walls and floor of the house are attached to the beams using fasteners, or the like. Jacks are then attached to the ends of the beams on the outside of the house, and the beams and house are jacked-up to a desired height. However, the beams used in the prior system are massive, and this system accordingly requires the use of heavy construction equipment for installing the beams in the house and for removing the beams from the house. Also, there is no provision for minimizing damage to the exterior walls of the house. Furthermore, preconstructed jacking towers are required if the house must be raised a significant height, and these jacking towers also require heavy equipment for transport and installation.

Accordingly, it will be apparent that a need exists for a more efficient and convenient method and apparatus to create a system for elevating a house or other structure. Under such a system, the apparatus should be able to lift a house having a concrete-slab foundation without the necessity of significant excavation. The method of the system should also enable the apparatus to be installed and removed without requiring the use of any heavy machinery, such a cranes or forklifts. In other words, all parts of the system should be able to be transported, installed, and removed by one or two people by hand. Finally, the system should be adaptable, versatile, and modular so that it may be used for a variety of different structures, floor plans, and the like, without having to design and build job-specific equipment. The method and apparatus of the present invention set forth such a system and provide a significant advance in the art.

SUMMARY OF THE INVENTION

In the preferred form of the system of the invention, a method and apparatus are provided for elevating a house, building, other structure, or the like. The apparatus of the system includes a plurality of releasably connectable beam elements or panels. The beam elements include a space-frame structure and include mateable ends whereby a first beam element may be connected to a second beam element in an endwise fashion for forming a longer unitary consolidated beam. Thus, any number of beam elements may be connected to one-another for forming a consolidated beam of any desired length. The beam elements are provided in several different lengths, and are light enough so that one or two individuals may lift and carry the beam elements for installation in a structure.

Under the method of the invention, a plurality of beam elements are connected to each other within the structure to be elevated for forming a plurality of consolidated beams. The consolidated beams are connected to the floor of the structure in a number of locations by fasteners. The fasteners may comprise expansion nuts which are inserted into holes formed in the floor of the structure. The expansion nuts are connected to the consolidated beams by threaded drop rods, nuts, and washers. By this method, each consolidated beam is connected to the floor of the structure in a plurality of locations. A plurality of consolidated jacking beams are also constructed, typically on the exterior of the structure, and are connected to the consolidated beams inside the structure. Lifting devices are installed under the jacking beams, and used to elevate the jacking beams, thereby elevating the structure.

The system may further include structural connecting members known as a drop beam and a drop post to enable use of the system without the necessity of significantly damaging the exterior walls of the house. The drop post is an elongate structural member connectable to the end of a beam element on one end, and connectable to the drop beam on the other end. Either before or after a consolidated beam is constructed by assembling a plurality of beam elements within a structure to be lifted, a hole may be formed in the floor of the house at each end of the consolidated beam near the exterior wall of the house. An adjacent cut out is formed in the exterior wall of the structure below floor level, the area under the floor is excavated, and the drop post is placed through the hole in floor. The drop post is connected to the end of the consolidated beam and extends down under the floor, near the periphery of the foundation. The drop beam is inserted through the cut out from the outside of the house, under the floor, and is connected to the drop post so that a portion of the drop beam extends out from under the edge of the house. A lifting device, such as the vertical support and jacking system of the invention is then connected to the drop beam outside the structure by connecting the drop beam to a consolidated jacking beam.

The invention is further directed to unique vertical support and jacking structures which are constructed from a plurality of small, generally similar block-like building elements or "cribs". The building elements may be bolted to each other to form posts. The building elements have a generally U-shaped appearance when viewed from top or bottom, i.e., the building elements are open or slotted on one side so that a hydraulic jack or cylinder or other equipment may be inserted into the interior of the building elements, or into a post formed from a stack of connected building elements. The hydraulic cylinders may be used within the posts to lift a load to a higher elevation. The load is progressively lifted by extending the jacks to lift the load, installing additional building elements into the spaces between the load and the tops of the posts, and then moving the jacks further up the posts so that the load may be lifted further by again extending the jacks. With each individual building element weighing less than 40 pounds, the system of the present invention makes it easy to lift a load and build up a variety of support structures without the use of heavy lifting equipment.

BRIEF DESCRIPTION OF THE DRAWINGS

The foregoing and additional objects, features, and advantages of the present invention will become apparent to those of skill in the art from a consideration of the following detailed description of a preferred embodiment of the invention, taken in conjunction with the accompanying drawings.

FIG. 28 shows a pair of posts for lifting a bridge or the like.

FIG. 34*a* shows a perspective view of a consolidated beam formed from a plurality of beam elements of the invention.

FIG. 34*b* shows a perspective view of an individual beam element of the invention.

FIG. 34*c* shows an enlarged elevation view of the beam element of FIG. 34*b*.

FIG. 34*d* shows a sectional view taken along line 34*d*—34*d* of FIG. 34*c*.

FIG. 34*e* shows a view taken along line 34*e*—34*e* of FIG. 34*c*.

FIG. 34*f* shows a connector member of the invention.

FIG. 39 shows a view taken along line 39—39 of FIG. 38 prior to elevation of the structure.

FIG. 40 shows the view of FIG. 39 with the structure undergoing elevation.

FIG. 42 shows a perspective view of two different lengths of slotted support beams.

FIG. 43 shows a fastening apparatus of the invention for connecting beam elements to the floor of a structure.

FIG. 46 shows an exploded perspective view of a drop beam and drop post of the invention.

FIG. 47 shows a perspective view of the apparatus of FIG. 45, as viewed from the exterior of the structure during the lifting process.

FIG. 48 shows a stabilizer yoke and a load transfer bar for use with the lifting devices of the invention.

FIG. 49 shows a view taken along line 49—49 of FIG. 38.

FIG. 57*a* shows yet another embodiment of the system of the invention.

FIG. 57*b* shows the embodiment of FIG. 57*a* during lifting of the structure.

DETAILED DESCRIPTION

Lifting and Shoring System

The present invention may be used to meet a variety of heavy lifting requirements, such as in the lifting of houses, buildings, structures, machinery, bridges, roofs, or the like. The present invention employs a plurality of substantially similar building elements or "cribs". The building elements may be releasably connected to each other to form posts or beams. The ends of the building elements are preferably precision ground so that when a plurality of building elements are stacked and bolted together they form posts or beams which are perfectly straight and resistant to buckling.

Advantageously, hydraulic cylinders or other lifting devices can be integrated with the building elements so that a load may be lifted or lowered from one elevation to another. A hydraulic cylinder may be incorporated within a post constructed from assembled building elements to progressively add or remove building elements to or from the post. This is accomplished by extending the cylinder to lift a load, thereby creating a gap at the top, bottom, or along the length of the post. An additional building element may then be placed within the gap. The cylinder may then be moved up or down within the post, and the sequence repeated, so that the load is progressively raised or lowered. Under the preferred embodiment of the system of the present invention, a load of up to 25 tons may be lifted from as low as 13 inches of clearance to any practical height. U.S. Pat. No. 5,575,591, entitled "Apparatus and Method for a Modular Support and Lifting System", to the same inventor as herein, sets forth a related system for shoring and lifting a load, and is incorporated herein by reference. This related system requires that a loading frame be used in most cases when elevating a load. The present invention eliminates the need for a loading frame, thereby also substantially reducing the starting height for lifting a load.

Figure 1:
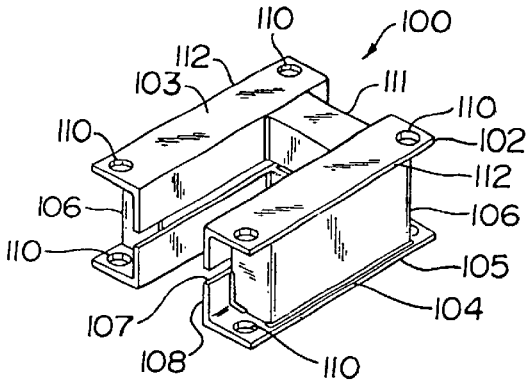
FIG. 1 shows a perspective view of a first embodiment of a building element of the present invention.
Figure 2:
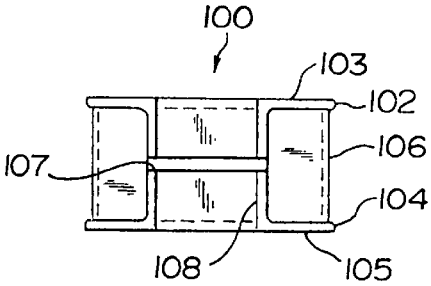
FIG. 2 shows a front view of the building element of FIG. 1.

FIGS. 1 and 2 show a block-like building element 100 for use with the present invention. Building element 100 includes an upper H-shaped mating member 102 and a generally identical lower H-shaped mating member 104. An opposed pair of C-shaped sections 106 connect upper mating member 102 to lower mating member 104. When assembled into a building element 100, upper mating member 102 forms an upper mating surface 103, while lower mating member 104 forms a lower mating surface 105, so that a plurality of building elements 100 may be connected to each other for forming elongate structures, as will be described below. In addition, C-shaped sections 106 are tall enough so that a gap 107 is formed between upper mating member 102 and lower mating member 104, the function of which gap 107 will be described below.

Figure 3:
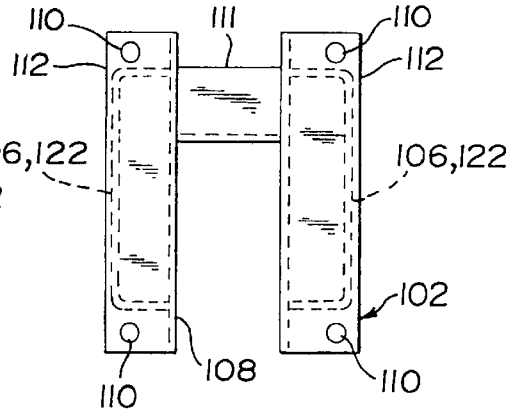
FIG. 3 shows a top view of the building elements of FIGS. 1 and 4.

As also illustrated in FIG. 3, mating members 102, 104 have an elongate, generally U-shaped, saddle opening 108 on one side to facilitate the insertion of a lifting device, such as a hydraulic cylinder, into the center of building element 100, as will be described in detail below. Mating members 102, 104 also include bolt holes 110 for releasably connecting one building element 100 to another by bolts (not shown) or other suitable fastening means.

As illustrated in FIG. 3, mating members 102, 104 are constructed from three pieces of angle welded together. A center angle 111 is welded transversely to two parallel side angles 112 to form a generally H-shaped mating member 102, 104. C-shaped sections 106 are then welded to either side of mating members 102, 104 for forming a complete building element 100. Following welding, the upper and lower respective mating surfaces 103, 105 of mating members 102, 104 are machined to be parallel so that when a plurality of building elements 100 are assembled to each other, the assembled building elements will form a straight elongate structural element.

It may also be noted that center angle 111 is offset with respect to the center of mating member 102, 104, when viewed in plan, as in FIG. 3. This leaves the center of building element 100 open for enabling a lifting device to be placed within the center of building element 100. Angles 111, 112 and C-shaped sections 106 are preferably formed of structural steel, although alternative materials may be used for particular applications. In the preferred embodiment, building element 100 is 10¾ inches long by 8½ inches wide by 4¾ inches high, and weighs approximately 28 pounds, so that building element 100 may be easily lifted and carried by a worker. Of course, alternative construction configurations may be used to form building element 100, so long as building element 100 has an upper mating surface, a lower mating surface, and an open side for allowing insertion of a lifting device.

Figure 4:
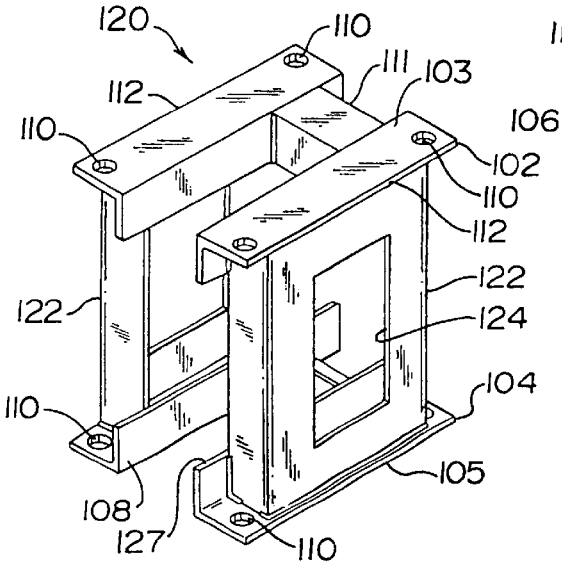
FIG. 4 shows a perspective view of a second embodiment of a building element of the present invention.
Figure 5B:
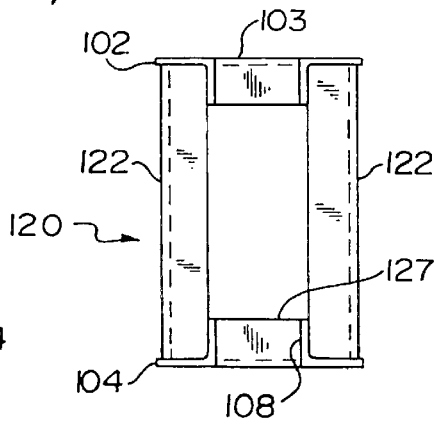
FIG. 5*b* shows a front view of the building element of FIG. 4.
Figure 5A:
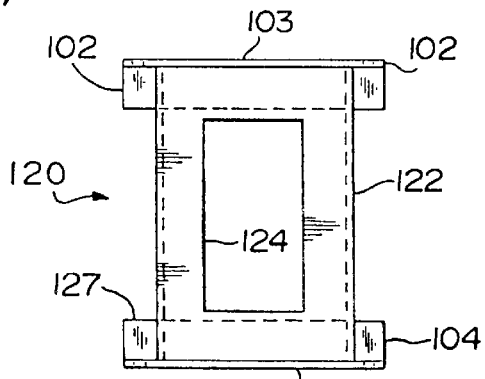
FIG. 5*a* shows a side view of the building element of FIG. 4.

FIGS. 4, 5*a* and 5*b* show a second embodiment 120 of a building element of the present invention. Building element 120 includes an upper mating member 102 and a lower mating member 104, as shown on building element 100, but building element 120 includes taller C-shaped sections 122. Taller C-shaped sections 122 may include lightening holes 124 for reducing the weight of building element 120. Building element 120 is generally identical to building element 100 when viewed from top or bottom, as shown in FIG. 3, and is of similar construction. In the preferred embodiment, building element 120 is 12 inches high, with the other dimensions being the same as in building element 100, and building element 120 weighs approximately 34 pounds. Of course, alternative heights for C-shaped section 122 may also be used. Accordingly, building element 120 has a substantially larger gap 127 than the gap 107 in building element 100. It may be seen that a building element 120 may be bolted to building elements 100 or to other building elements 120 for creating elongate structures, such as posts or beams.

Figure 6:
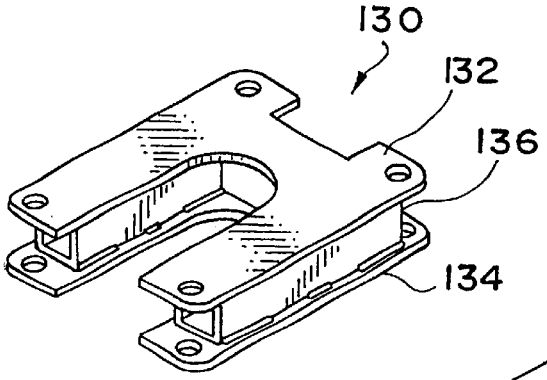
FIG. 6 shows a perspective view of a third embodiment of a building element of the present invention.

FIG. 6 shows a third embodiment of a building element 130 of the present invention. Building element 130 includes an upper mating plate 132 and a lower mating plate 134, which are of size and shape to match upper and lower mating members 102, 104 on building elements 100 and 120. However, building element 130 includes a shorter central U-shaped body 136 formed of square tubing. Building element 130 is preferably approximately 2 inches in height, and is primarily used as a filler block or fall-back block along with shims and wedges as will be described below. It may be seen that a building element 130 may be bolted to a building element 100, 120 or to other building elements 130 for creating elongate structures.

Figure 7:
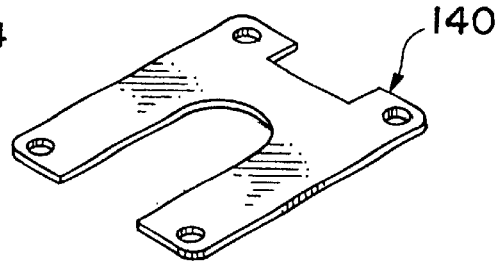
FIG. 7 shows a perspective view of a spacer plate.
Figure 8:
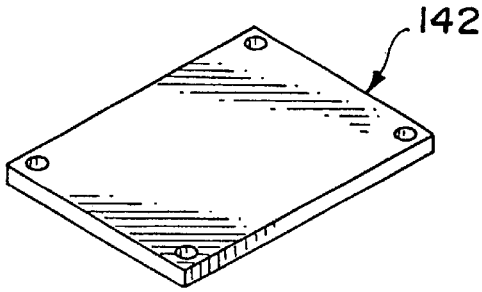
FIG. 8 shows a perspective view of a cap/base plate.

FIG. 7 shows a spacer plate 140 which may be used anywhere in a crib post to accommodate specific situations such a adjusting the distance between a building element mating surface and a load. FIG. 8 shows a cap/base plate 142 which is a rectangular steel plate ¾ inch thick. Cap/base plate 142 may be used at the top or bottom of a post of assembled building elements 100, 120, 130 for providing a bearing surface for wedges, shims, or the like, or for providing a bearing surface for a post.

Figure 9:
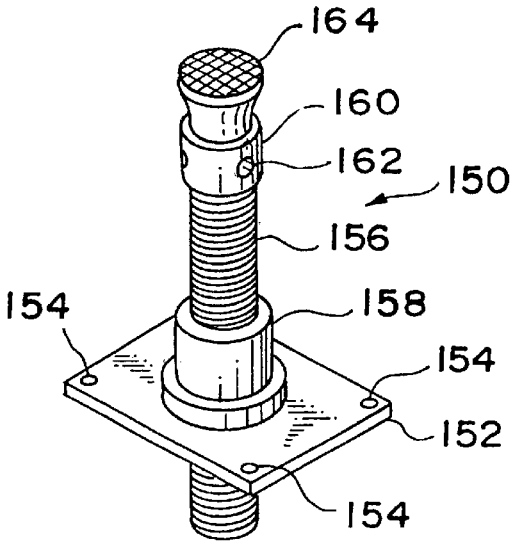
FIG. 9 shows a perspective view of a cap plate and screw jack combination.
Figure 10:
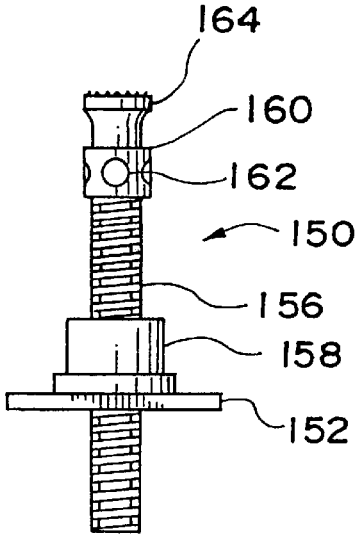
FIG. 10 shows a side view of the screw jack of FIG. 9.

FIGS. 9 and 10 show a screw-and-cap assembly 150 for mounting on top of a post of assembled building elements 100, 120, 130. Screw-and-cap assembly 150 includes a flange plate 152 which has bolt holes 154 located in a pattern which match upper mating surface 103 of building elements 100, 120, 130. A screw 156 fits within a threaded bushing 158 mounted on flange plate 152. The height of screw 156 may be adjusted vertically by turning. To facilitate turning of screw 156, a screw head 160 is included near the top of screw 156, and includes hole 162 for insertion of a lever bar (not shown). The lever bar may be inserted into hole 162 and used to turn screw 156 in the desired direction for raising or lowering screw 156. Located above screw head 160 is a cap 164 which bears against a load. Cap 164 is mounted for rotation of up to nine degrees on a chrome moly ball (not shown).

Figure 11:
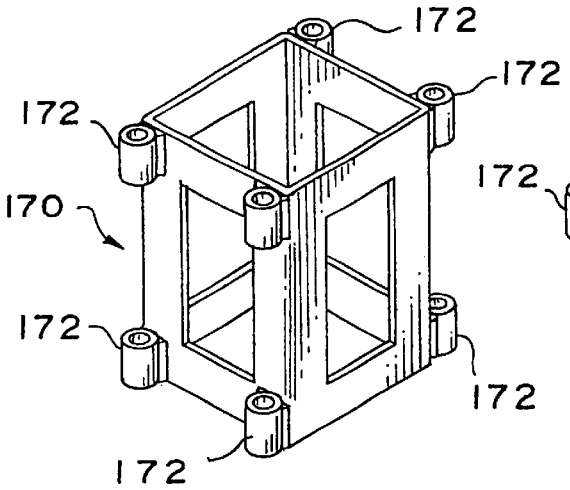
FIG. 11 shows a perspective view of a fourth embodiment of a building element.
Figure 12:
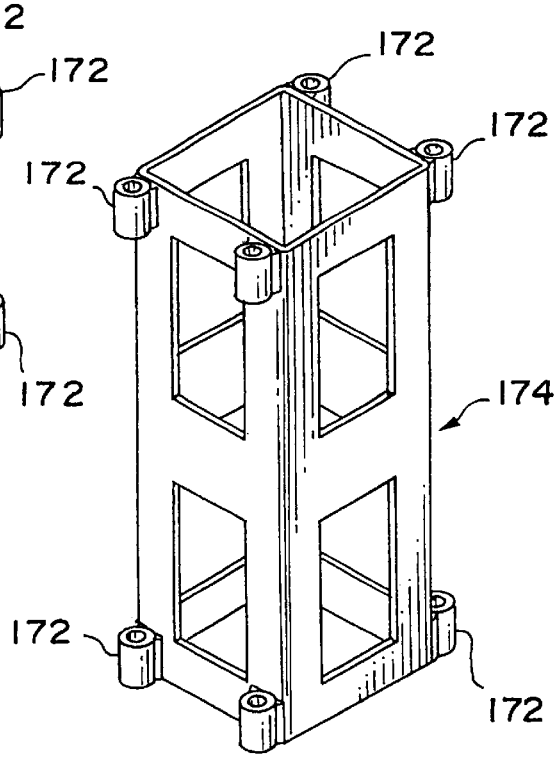
FIG. 12 shows a perspective view of a fifth embodiment of a building element.

FIGS. 11 and 12 show additional building elements which may be used in combination with building elements 100, 120, 130 and the other equipment described above. The construction and use of these building elements are described in the above-referenced U.S. Pat. No. 5,575,591 to the same inventor as the present application.

FIG. 11 shows a box building element 170 which includes a plurality of mating lugs 172 for enabling box building element 170 to be bolted to building elements 100, 120, 130, or other box building elements 170. FIG. 12 shows a box building element 174 which is similar to box building element 170 except that it is of greater height. The use of the box building elements 170, 174 in combination with building elements 100, 120, 130 increases the versatility of the system.

Figure 13:
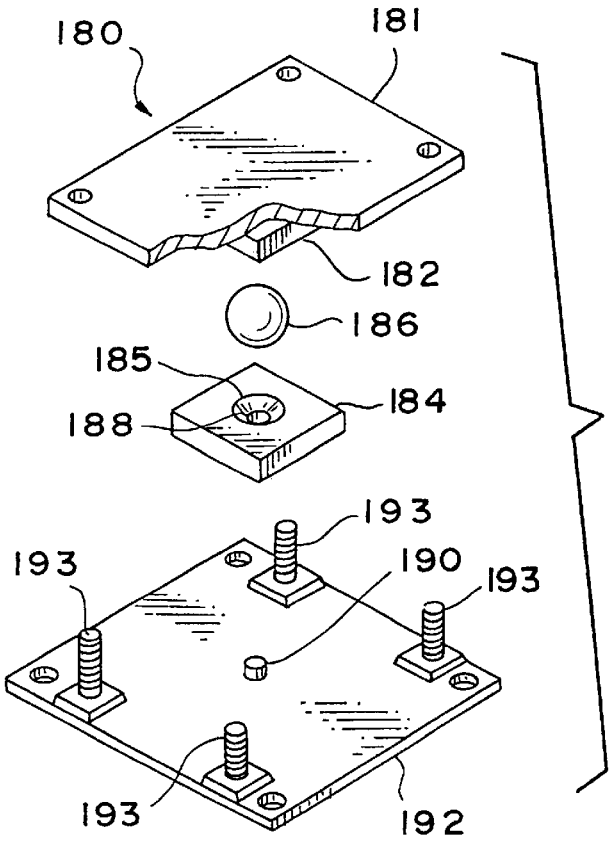
FIG. 13 shows an exploded view of a knuckle joint and base plate combination.

Posts constructed from building elements 100, 120, 130, 170, 174 may be mounted on several different base assemblies depending upon the underlying bearing surface. FIG. 13 shows a knuckle joint and base plate mounting combination 180. The knuckle joint and base plate combination 180 is advantageous because it provides a post with a self-centering ability that ensures concentric support, and enables a plumb post to be built on ground that is not level. A support plate 181 has a bolt pattern which matches that of building elements 100, 120, 130, 170, 174. Support plate 181 includes an upper knuckle plate 182 welded thereto. A matching lower knuckle plate 184 is assembled below upper knuckle plate 182, and both upper and lower knuckle plates include matching hemispherical indentations 185 for receiving a bearing ball 186. Lower knuckle plate 184 includes a locating hole 188 which passes through the center of lower plate 184. A locating pin 190 is fixed at the center of base plate 192, and locating pin 190 is inserted into locating hole 188 when lower knuckle plate 184 is assembled onto base plate 192. Four high strength studs 193 project upward from base plate 192. Studs 193 are configured in the same bolt pattern as building elements 100, 120, 130, 170, 174, and may be used to adjust a post of assembled building elements for plumbness when assembled as shown in FIGS. 15*a*–15*c* by adjusting nuts 195.

Figure 14B:
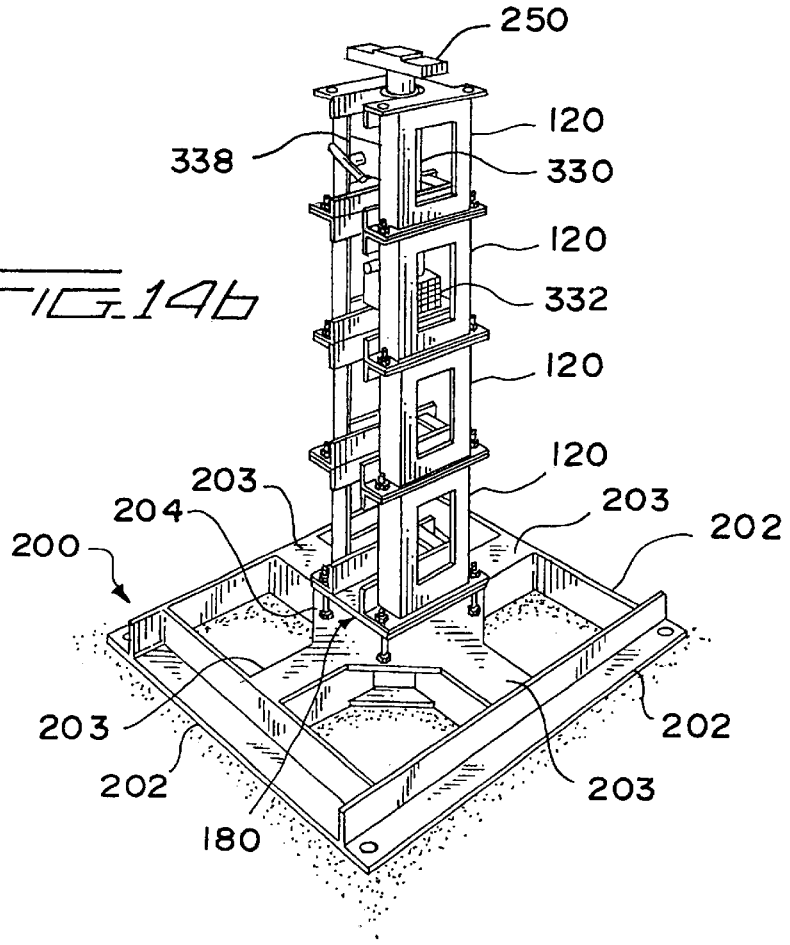
FIG. 14*b* shows the all-terrain base of FIG. 14*a* with a post mounted thereon.
Figure 14A:
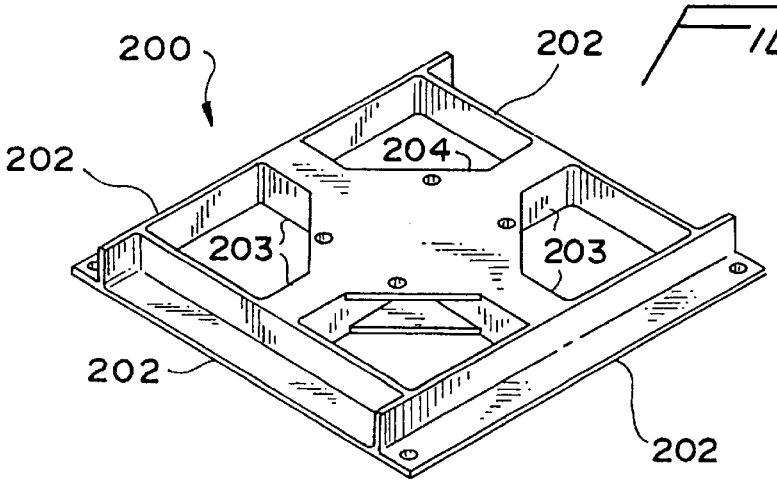
FIG. 14*a* shows an all-terrain base.
Figure 15A:
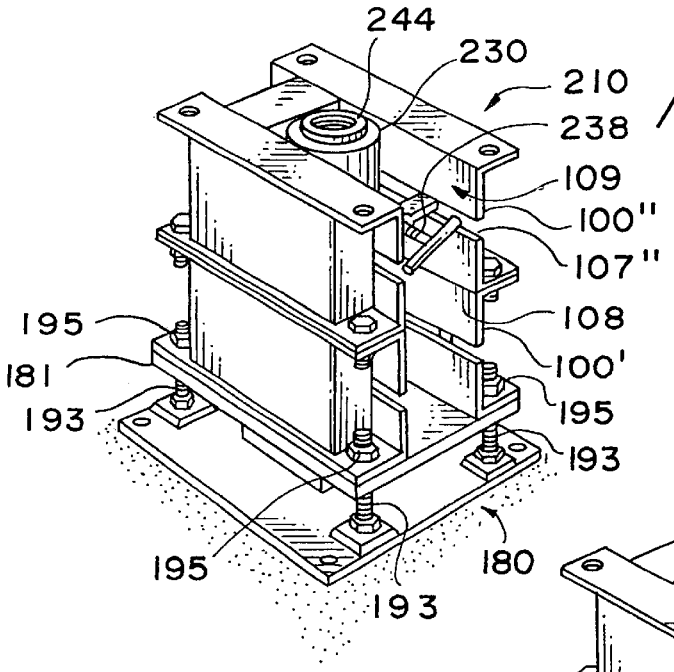
FIG. 15*a* shows a perspective view of a post constructed from a plurality of building elements.
Figure 15B:
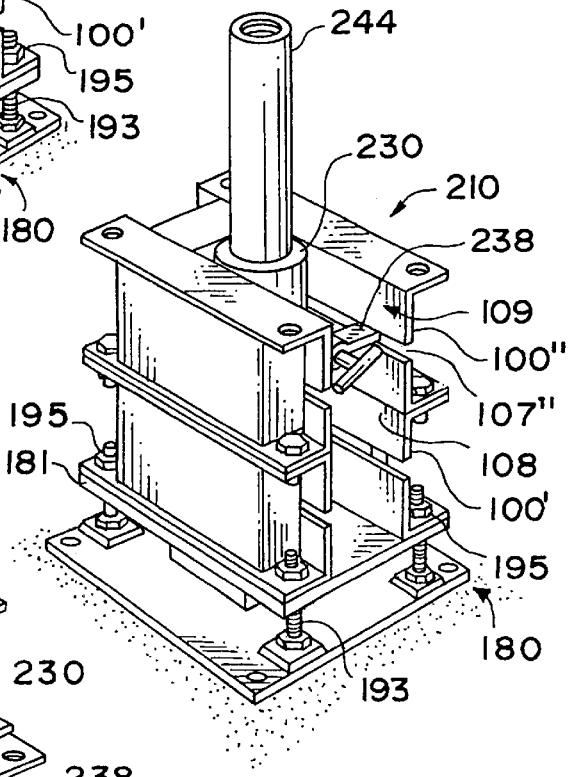
FIG. 15*b* shows the post of FIG. 15*a* with the cylinder ram extended.
Figure 15C:
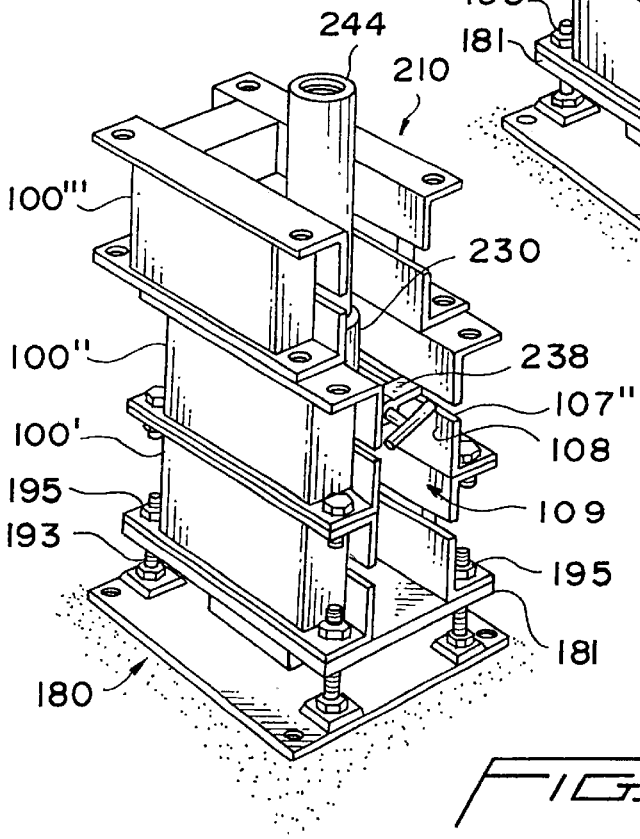
FIG. 15*c* shows the post of FIG. 15*a* to which an additional building element is being added.

The knuckle joint and base plate mounting combination is used when a post is to rest on a concrete surface, as shown in FIGS. 15*a*–*c*. If plumbness of a post is not a concern, as when the post will be relatively short in height, then the building elements may be mounted on a cap/base plate 142, or simply placed on the concrete surface. When the post of assembled building elements is to be located on a dirt or similar surface, an all-terrain base 200 is used, as shown in FIGS. 14*a* and 14*b*. All-terrain base 200 is constructed from four angle members 202, crossed box beam members 203, and includes a base plate 204 located at its center. Base plate 204 includes a bolt pattern for mounting building elements 100, 120, 130, 170, 174, and also may include a locating pin (not shown) to allow the use of the knuckle joint assembly 180 described above, with base plate 204 replacing base plate 192. FIG. 14*b* shows an all-terrain base 200 having a post constructed from building elements 120 mounted thereon in conjunction with a knuckle joint assembly 180.

Figure 16:
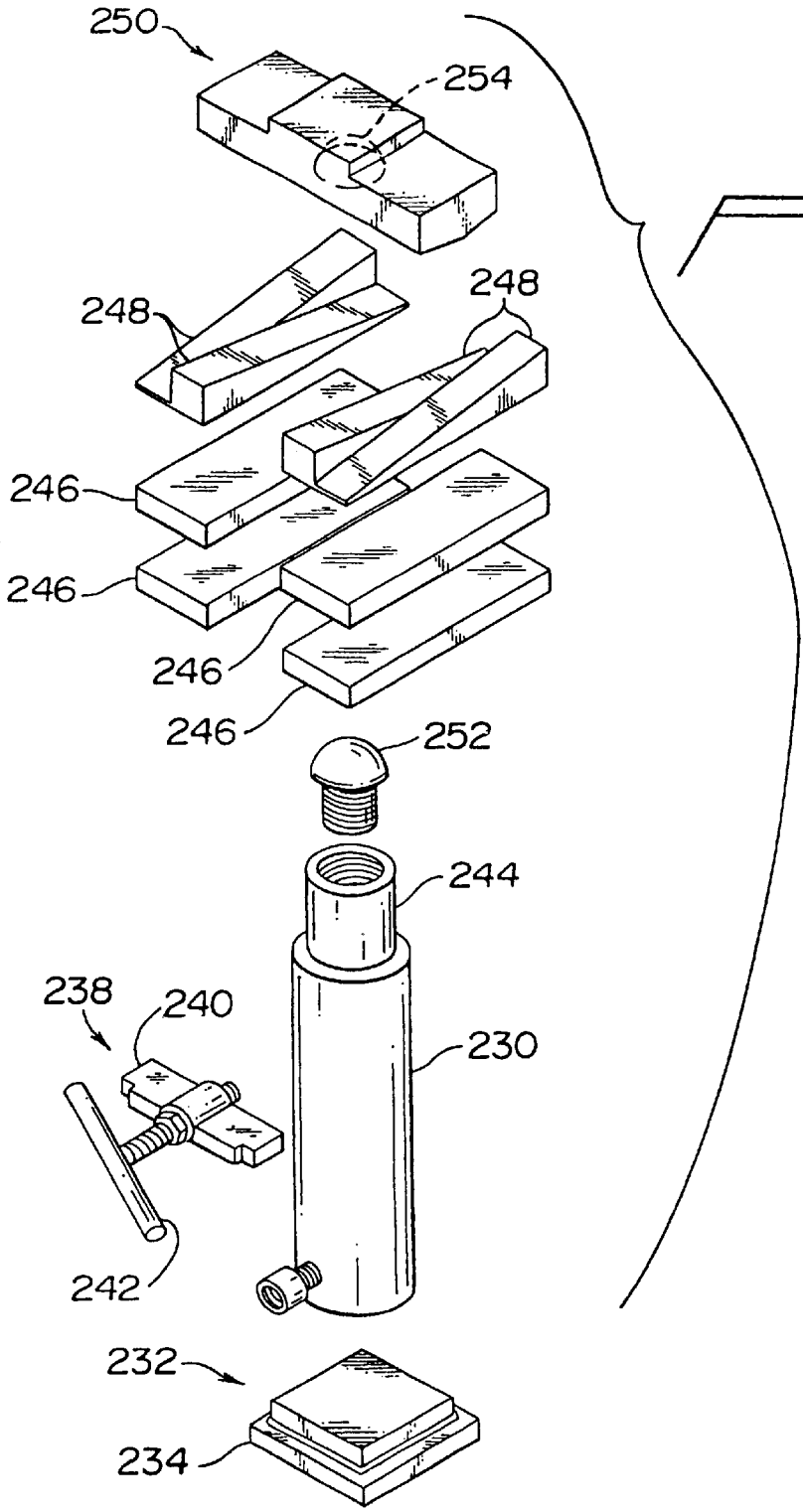
FIG. 16 shows an exploded view of lifting accessories for use with the building elements of the first embodiment of the present invention.

The basic method of operating the system of the present invention will now be described with reference to FIGS. 15*a*–15*c*. FIG. 15*a* shows an elongate structure or post 210 comprised of a first lower building element 100' bolted onto a knuckle joint and base plate combination 180. An upper second building element 100" is bolted to lower building element 100'. It may be seen that since building elements 100', 100" are open on one side, U-shaped openings 108 combine to form a slot 109 along one side of post 210. Located within slot 109 of post 210 is a lifting device such as a hydraulic cylinder 230, which is also illustrated in FIG. 16. Hydraulic cylinder 230 is preferably aligned with the major central axis of post 210 for supporting or lifting a load 233 (load illustrated in FIGS. 20*a*–20*c*; load not shown in FIGS. 15*a*–15*c* for clarity). Hydraulic cylinder 230 rests on base plate 181, or, if hydraulic cylinder 230 is to be installed at a location above base plate 181, hydraulic cylinder 230 is mounted on a shelf plate 232, as shown in FIG. 16. Shelf plate 232 has a flange 234 which enables shelf plate 232 to supported in gap 107 on a building element 100, as will be described in more detail below. Hydraulic cylinder 230 is preferably a standard 25 ton, 6 inch stroke hydraulic jack available from a variety of sources.

Figure 17:
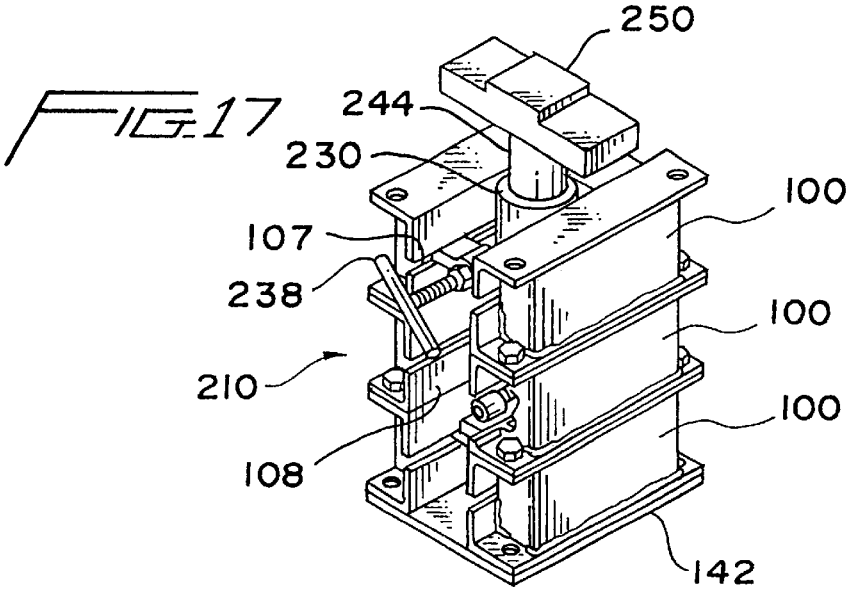
FIG. 17 shows a perspective view of a post having the lifting accessories of FIG. 16 installed.
Figure 18:
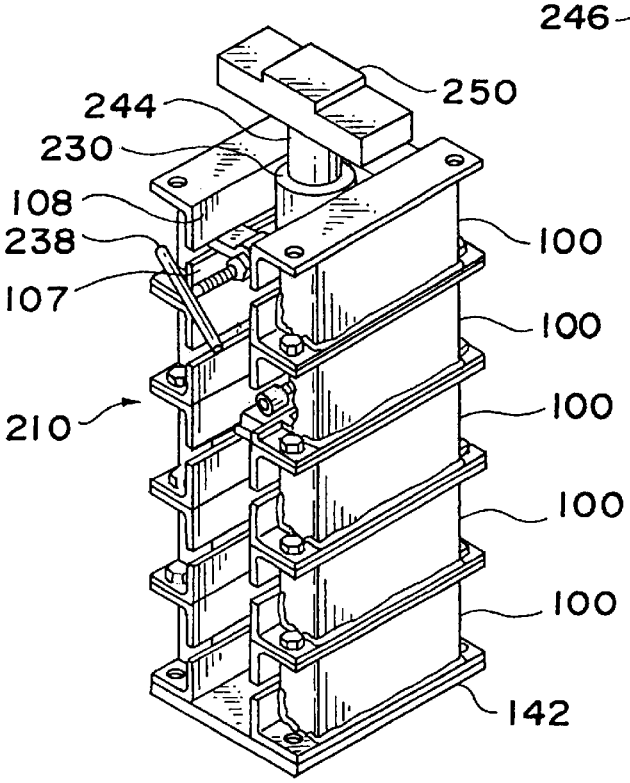
FIG. 18 shows a perspective view of the post of FIG. 17 following the addition of additional building elements.

A lateral support element 238, as also illustrated in FIG. 16 may be used to prevent lateral movement of cylinder 230. Lateral support element 238 includes a threaded plate 240 and thumb screw 242. Threaded plate 240 fits within gap 107" on building element 100", as also illustrated in FIGS. 17 and 18. Threaded plate 240 bears against C-shaped section 106 by spanning opening 108. Thumb screw 242 is tightened to press cylinder 230 against building elements 100', 100", so that cylinder 230 will not slip out of slot 109.

As illustrated in FIGS. 16–19, hydraulic cylinder 230 also may include a load transfer bar 250 mounted on the top of ram 244. As shown in FIG. 16, a ball cap 252 may be attached to the top of ram 244 by threads or other means. Ball cap 252 has a semi-spherical bearing surface, and a matching semi-spherical cup 254 is formed in the underside of load transfer bar 250 for receiving ball cap 252. Ball cap 252 and semi-spherical cup 254 help ensure that post 210 remains plumb despite angular variations between load 233 and post 210. Load transfer bar 250 also has a generally V-shaped underside when viewed in cross section from the end. The V-shaped underside facilitates the use of steel wedges 248 along with shims 246 during the lifting process, as is apparent from FIG. 19. In addition, load transfer bar 250 distributes the force of ram 244 on the load during lifting, and transfers the load from ram 244 to post 210 during the resetting mode.

Figure 19:
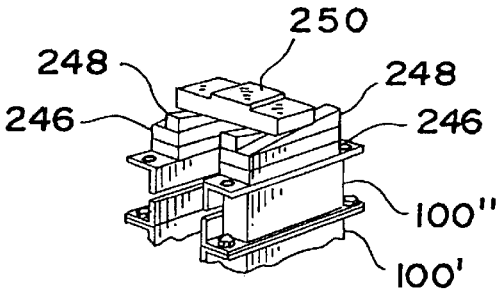
FIG. 19 shows the use of shims and wedges during the lifting cycle.

As illustrated in FIG. 15*a*, with cylinder 230 mounted within post 210, and with post 210 positioned beneath a load, hydraulic fluid under pressure may be delivered to cylinder 230 from a portable hydraulic pump or the like (not shown). This causes cylinder ram 244 to extend, as shown in FIG. 15*b*, thereby lifting the load a predetermined distance greater than the height of a building element 100. Because of the possibility of hydraulic failure, the gap between load 233 and the top of crib post 210 is filled temporarily with shims 246 and wedges 248, as shown in FIG. 19, or with shorter building elements 130. Once full extension of ram 244 is accomplished, a third building element 100"' may then be added to post 210, as shown in FIG. 15*c*.

Once third building element 100"' is bolted to upper building element 100", and shims 246 and/or wedges 248 added as desired to take up any additional gap between third building element 100"' and the load, the hydraulic pressure to cylinder 230 may be relieved, and the load allowed to rest on load transfer bar 250 or the top of post 210. Cylinder 230 may then be removed from crib post 210, and reinstalled one building element higher, as illustrated in FIGS. 20*a*–20*c*.

Figure 20C:
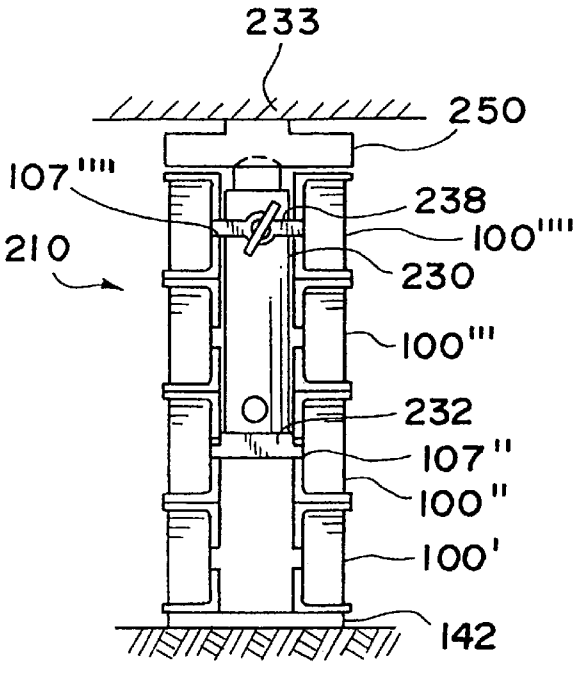
FIG. 20*c* shows the post of FIG. 20*b* following addition of an additional building element, with the lifting device repositioned.
Figure 20B:
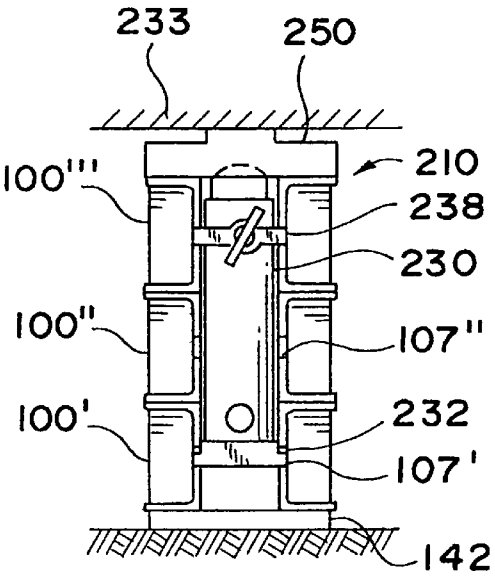
FIG. 20*b* shows the post of FIG. 20*a* following addition of an additional building element, with the lifting device repositioned.
Figure 20A:
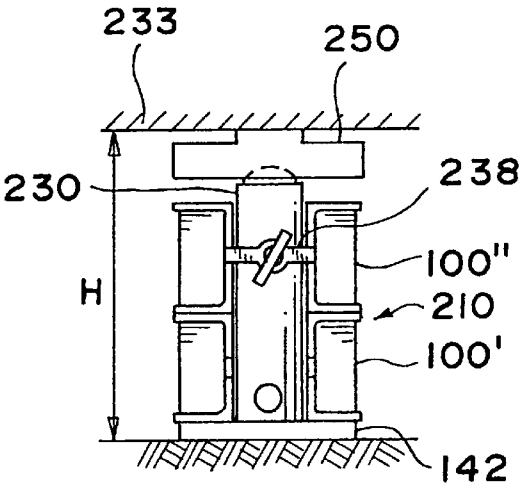
FIG. 20*a* shows a front view of a post having a lifting device installed therein.

In FIG. 20*a*, cylinder 230 is initially resting on a base plate 142 (the knuckle and base plate combination 180 is not shown in FIGS. 20*a*–20*c*). In FIG. 20*b*, a third building element 100"' has been added to post 210, by the method illustrated in FIGS. 15*a*–15*c*. Cylinder 230 has also been moved up, and is resting on shelf plate 232. Shelf plate 232 fits within gap 107' of building element 100'. It may be seen that shelf plate flange 234 fits within gap 107', so that shelf plate 232 can support cylinder 230. Thus, by using shelf plate 232, cylinder 230 may be placed in and supported by any building element 100 in post 210 if there is sufficient clearance from the top of the post. The maximum recommended unbraced height for a post 210 constructed from building elements 100 is 14 feet. However, if lateral bracing supports are incorporated, the maximum allowable height may be substantially greater.

In FIG. 20*c*, cylinder 230 has again been extended and a fourth building element 100"" has been placed on top of post 210. Shelf plate 232 is again moved up to gap 107" of second building element 100", and hydraulic cylinder 230 is placed within second, third and fourth building elements 100", 100"', and 100"". Lateral support element may then be installed into gap 107"" in fourth building element 100"", and the lifting step repeated to enable the placement of a fifth building element (not shown). In this manner, any number of building elements 100 may be added to post 210 for lifting a load to a desired height. It will be apparent that once load 233 has been lifted to a desired height, it may be supported at that height by a post 210 indefinitely, and then, if desired, lowered back to a lower level by reversing the above-described process.

It should be further noted that FIG. 20*a* illustrates the minimum height clearance H for which the system of the present invention is designed. In the preferred embodiment the minimum height H is 13 inches when post 210 is mounted on a base plate 142 (illustrated in FIGS. 20*a*–20*c*), and approximately 3 inches more when post 210 is mounted on a knuckle joint combination 180 (illustrated in FIGS. 15*a*–15*c*). Thus, a post 210 of the present invention may be constructed to lift a load of as much as 25 tons from a minimum height of 13 inches to practically any desired height.

Figures 21A, 21B, 21C, 21D:
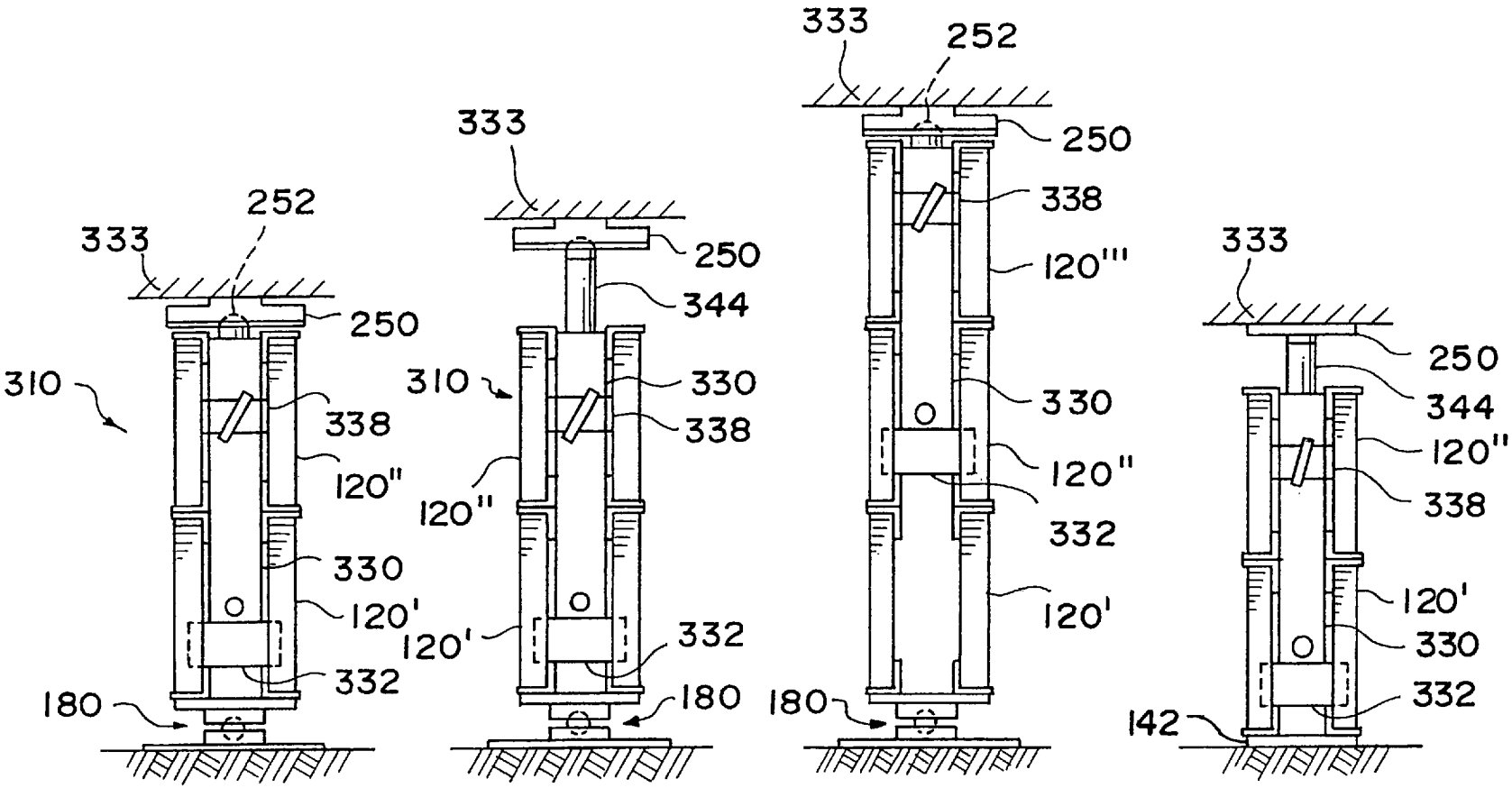
FIG. 21*a* shows a front view of a post constructed from building elements of the second embodiment, with a lifting device installed therein.
FIG. 21*b* shows the post of FIG. 21*a* with the load partially elevated.
FIG. 21*c* shows the post of FIG. 21*b* after full elevation of the load and the addition of an additional building element.
FIG. 21*d* shows the post of FIG. 21*a* mounted on a base plate.
Figure 25:
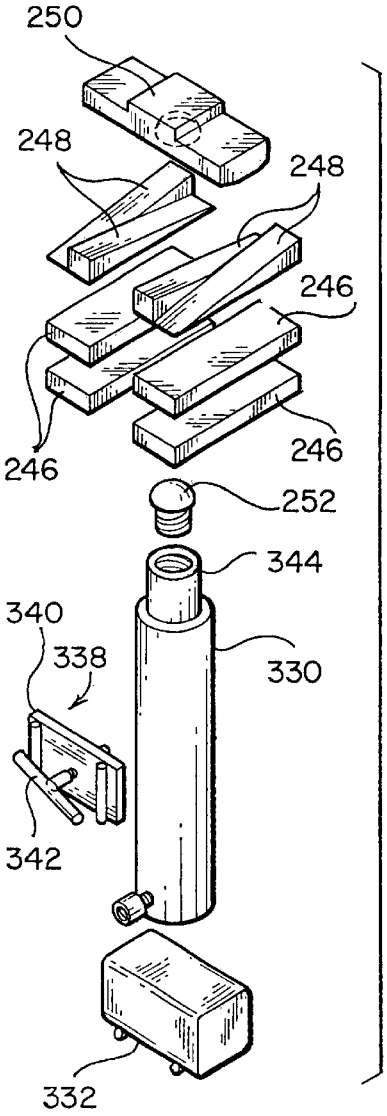
FIG. 25 shows an exploded view of lifting accessories for use with the building elements of the second embodiment.
Figure 22:
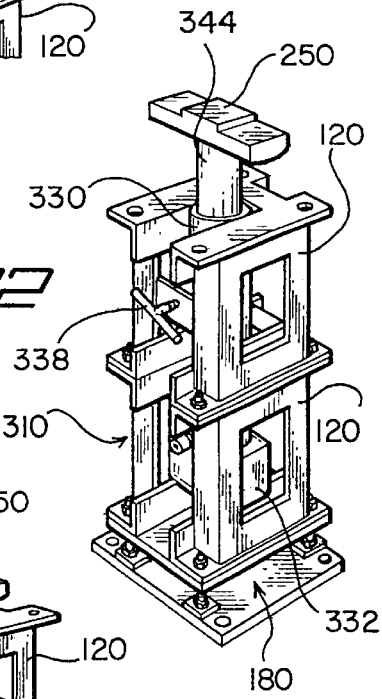
FIG. 22 shows a perspective view of the post of FIG. 21*a*.
Figure 23:
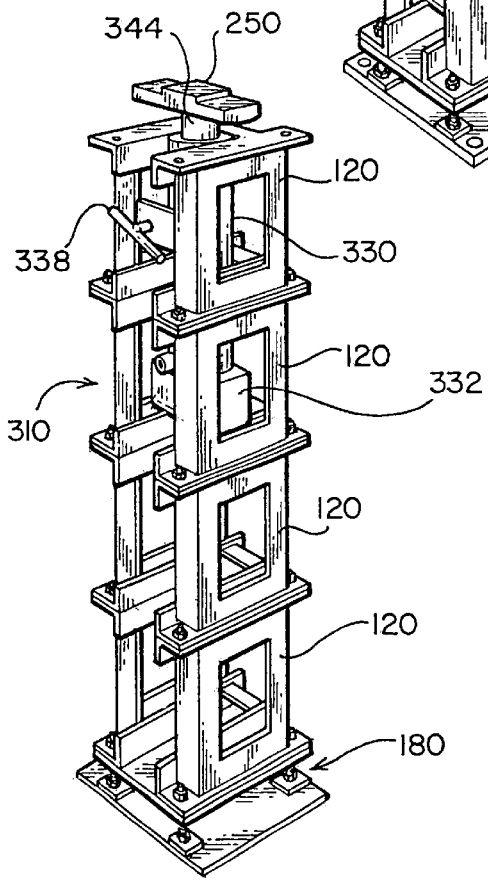
FIG. 23 shows the post of FIG. 22 following addition of additional building elements.

A similar post 310 may be constructed using building elements 120, as illustrated in FIGS. 21*a*–21*d* and 22–24. For post 310 constructed using building elements 120, a cylinder 330 having a longer, 14 inch stroke, as shown in FIG. 25 may be used. Cylinder 330 may be used with a shelf beam 332, as shown in FIGS. 22, 23, and 25 or with shelf plate 232. A lateral support element 338 may also be used with building elements 120. Lateral support element 338 is of similar construction and function as lateral support element 238 described above, but includes a larger threaded plate 340. Also, as is apparent from FIG. 24, a combination of building elements 100, 120 of different heights and wedges 248 or shims 246 may be used to provide support for a load at a desired height and to prevent fall-back following removal of hydraulic power.

Figure 24:
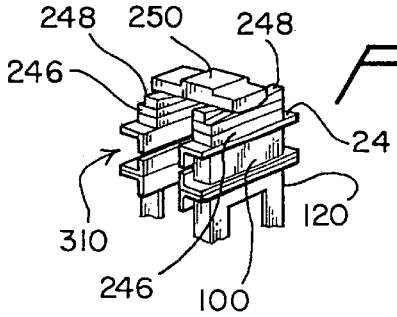
FIG. 24 shows the use of wedges and shims during the lifting of a load.

It may be seen from FIGS. 21*a*–21*c* that post 310 may be used to elevate a load 333 in a manner similar to post 210 described above. FIG. 21*a* shows post 310 prior to beginning the lifting process. FIG. 21*b* shows ram 344 partially extended as cylinder 330 is activated to elevate load 333. It is desirable that shims 246, wedges 248, or building elements 100, 130 be placed under load 333 at this point to protect against fall back, as shown in FIG. 24. Following full extension of cylinder 330, any shims 246, wedges 248, or building elements 100, 130 are removed, and an additional building element 120''' is placed on top of post 310 and bolted to building element 120''. Cylinder 330, shelf member 332, and lateral support 338 may then be moved up one building element, to the position shown in FIG. 21*c*, and the lifting process may be repeated. FIG. 21*d* shows post 310 of FIG. 21*a* constructed on a base plate 142, rather than a knuckle joint and base plate combination 180.

It may be seen that the components of the present invention are interchangeable, and capable of meeting a variety of support and lifting needs. The system of the present invention may be used for simply lifting a piece of equipment, or may be used to lift an entire building. Through the use of cross supports, lateral bracing and other structural reinforcements set forth in the above-referenced U.S. Pat. No. 5,575,591, an almost limitless range of support and lifting structures may be built. Furthermore, when one project is complete, the parts may be used again in other projects where lifting and support requirements may be vastly different. Typical uses for the lifting and shoring system of the present invention include lifting (or lowering) a roof, a bridge, a house, a piece of machinery, or other heavy objects and structures.

All the parts of the present invention are sufficiently light in weight that they may be carried and installed by hand. Thus, hoists, cranes, forklifts, or other heavy lifting equipment are generally not required. All accessories, such as nuts, bolts, and hydraulic equipment are standard off-the-shelf parts, and may generally be obtained from local suppliers.

Using the system of the present invention, loads may be lifted to practically any height as long as sufficient lateral restraint is incorporated with the posts. Lowering a load is performed by reversing the lifting process, although controlled-rate snubber valves are recommended during lowering so that the rate at which the load drops is carefully controlled. In addition, during lifting using multiple posts at multiple points simultaneously, a lifting synchronization control system is recommended, as set forth in U.S. Pat. Nos. 4,251,974 and 4,832,315, to the same inventor as herein, and which are incorporated herein by reference, and as also described below with reference FIGS. 53–55 for elevating a structure. Briefly, this synchronization system uses movable tapes and sensors to control the hydraulic pumps which supply fluid to the lifting cylinders. The synchronization system gives an exact indication of elevation, and enables an operator to monitor lifting at up to 48 or more points simultaneously at a single control station.

Figure 26:
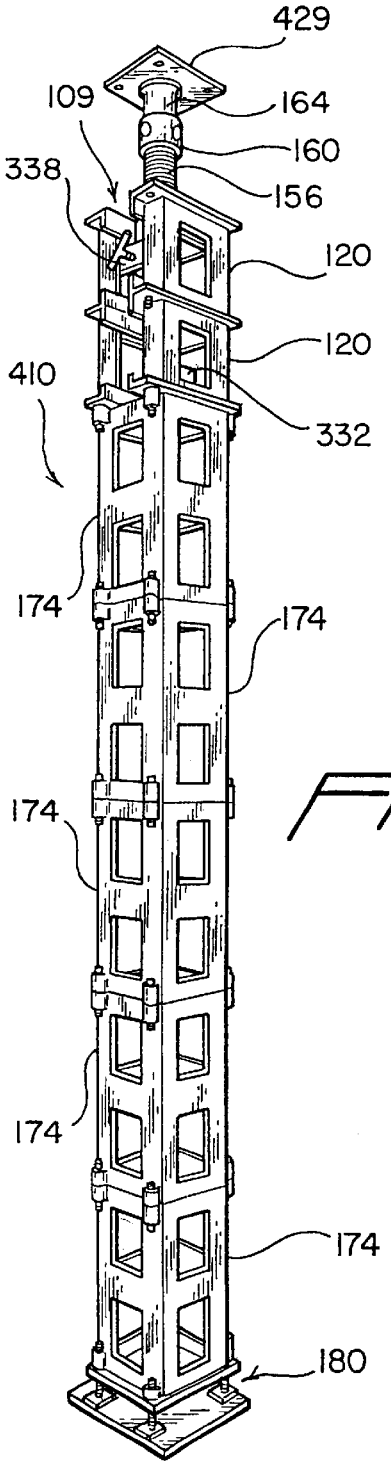
FIG. 26 shows a shore post constructed from building elements of the present invention.
Figure 27:
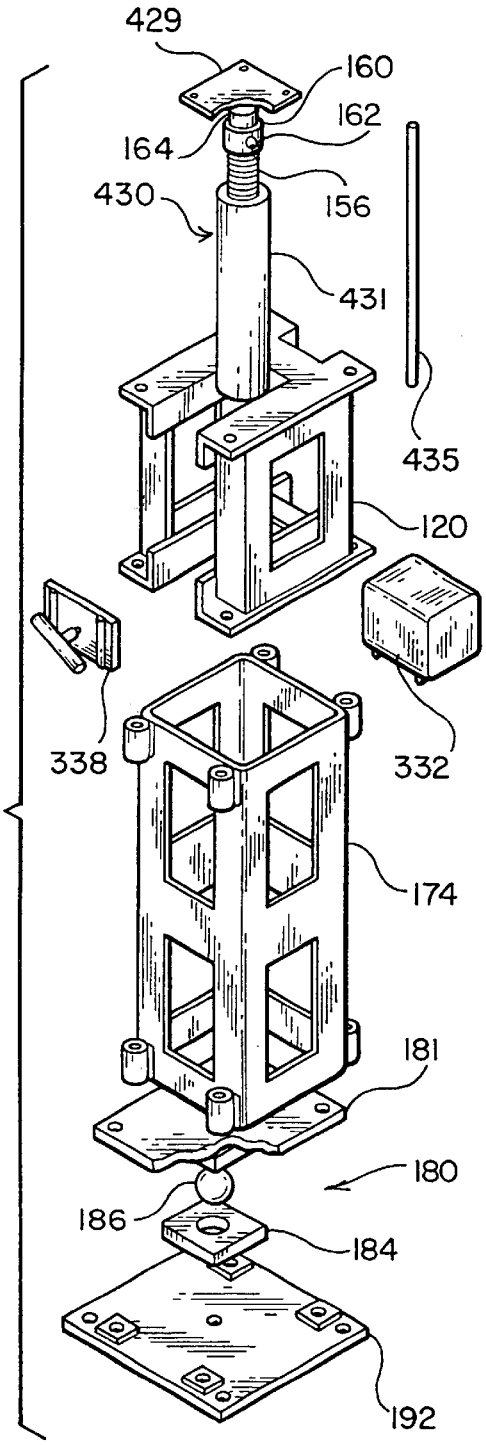
FIG. 27 shows the elements used in constructing the post of FIG. 26.

FIG. 26 shows use of the present invention for constructing a shoring post 410. The components used to construct shoring post 410 are set forth in FIG. 27, and it may be seen that post 410 is mounted on a knuckle joint and base plate combination 180, and includes a plurality of building elements 174, with at least two building elements 120 having openings 108 mounted on top thereof for forming a slot 109. A lifting device 430 is mounted within slot 109 of building elements 120 for preloading post 410. Lifting device 430 is preferably a screw jack similar to that described in FIGS. 9 and 10. However, as shown in FIG. 27, lifting device 430 is not mounted to a cap plate, but instead, includes a cylindrical body 431 having internal threads for receiving screw 156. A top plate 429 is attached to cap 164 by welding or the like. Lifting device is activated by turning screw 156 using lever bar 435. A load of up to 24 tons may be lifted in this manner. It is recommended that top plate 429 be bolted or welded to the load (not shown), because considerable side forces may be exerted on top plate 429 during turning of screw 156. These side forces could otherwise cause post 410 to slip from under the load.

It may be seen that lifting device 430 may be installed and used in a similar manner to lifting devices 230 and 330 described above. Thus, a load may be elevated, and an additional building element 120 may be placed on top of post 410. Lifting device 430, shelf beam 332, and lateral support 338 may then be moved up one building element 120, and the process repeated, as described above. Alternatively, of course, a hydraulic lifting device may be used, but hydraulics are not recommended for supporting a load for extended periods of time since a pressure failure could lead to collapse of the lifting device, and consequent dropping of the load.

Figure 28:
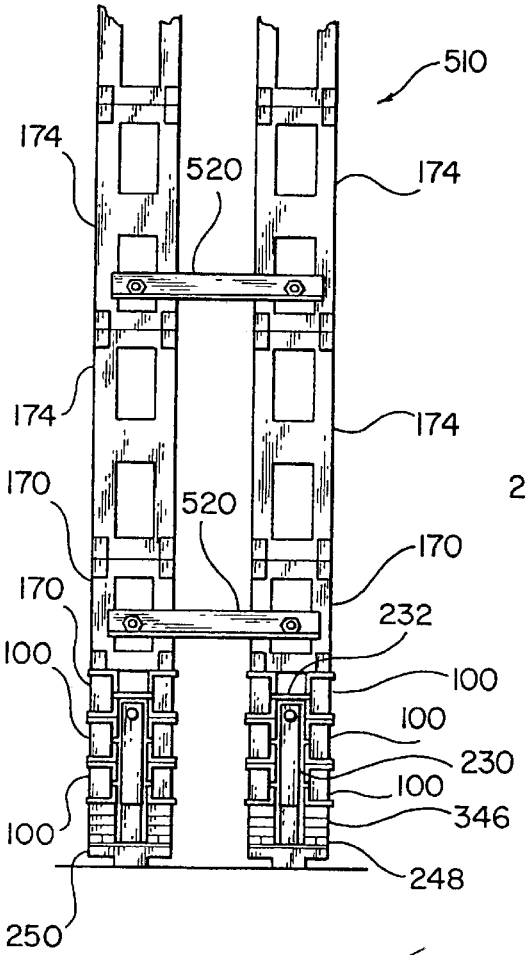
Figure 29:
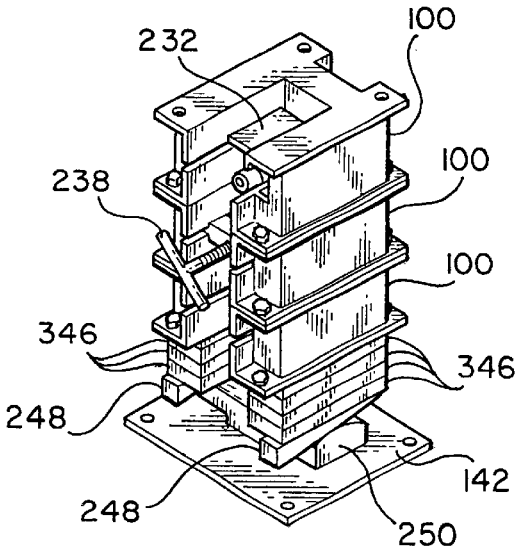
FIG. 29 shows a perspective detail of the lower portion of the post of FIG. 28.
Figure 30:
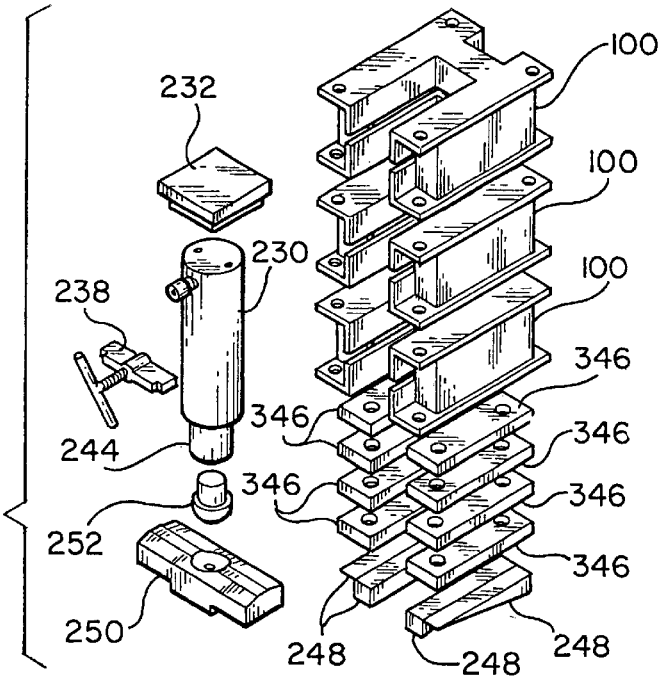
FIG. 30 shows an exploded view of the post of FIG. 29.

FIG. 28 shows a pair of posts 510 which may be used for elevating heavy structures, such as bridges or the like. Each post 510 is constructed from a plurality of building elements 174, 170, as shown, and includes a plurality of building elements 100 at the base for facilitating lifting. Lateral bracing supports 520 are included for connecting one post 510 to the other post 510. In this manner the safe maximum height of the posts may be increased. The lifting accessories located in the plurality of building elements 100 at the bottom of posts 510 are configured upside down in comparison to the previous examples. As also illustrated in FIGS. 29 and 30, shelf plate 232, cylinder 230, and load plate 250 are all configured to enable extension of ram 244 toward the ground. It may be seen that as ram 244 is extended, not only the load, but the entire post 510 is lifted. An additional building element 100 may then be placed on the bottom of post 510, and the process repeated for progressively elevating the load and post 510.

Advantageously, magnetic shims 346 are provided for use with this configuration. Magnetic shims 346 adhere to the bottom of the bottom-most building element 100, for facilitating insertion of shims 346 and wedges 248 during the lifting process to protect against fall-back in case of hydraulic failure.

Figures 31, 32, 33:
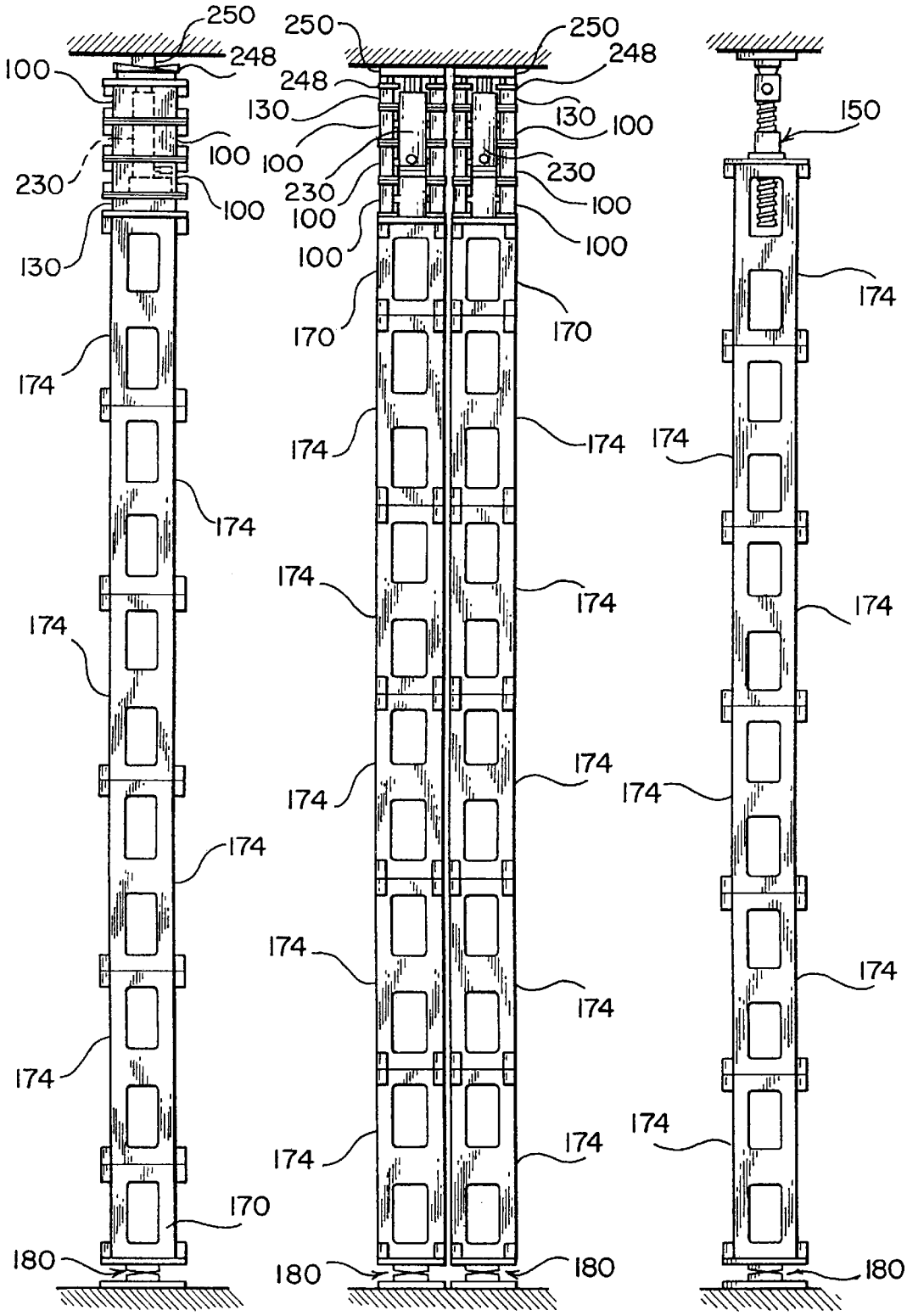
FIG. 31 shows an alternative example of a structure constructed from building elements of the present invention.
FIG. 32 shows an alternative example of a structure constructed from building elements of the present invention.
FIG. 33 shows an alternative example of a structure constructed from building elements of the present invention.
Figure 35A:
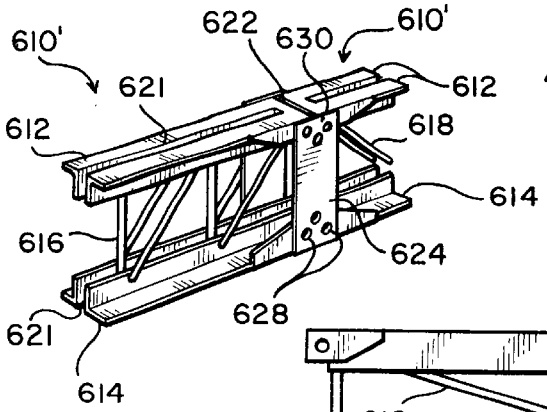
FIG. 35*a* shows a perspective view of a second consolidated beam formed from a plurality of modified beam elements of the invention.
Figure 36A:
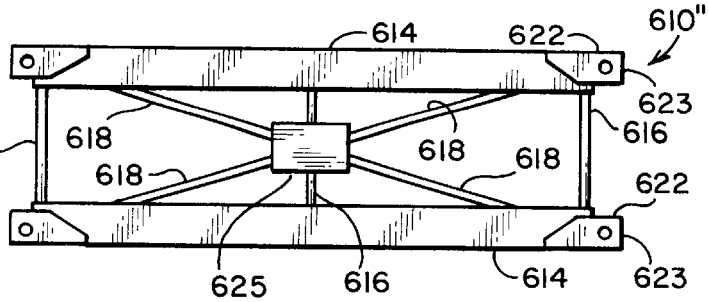
FIG. 36*a* shows an elevation view of a third beam element of the invention, with a four-foot long beam element illustrated.
Figure 36B:
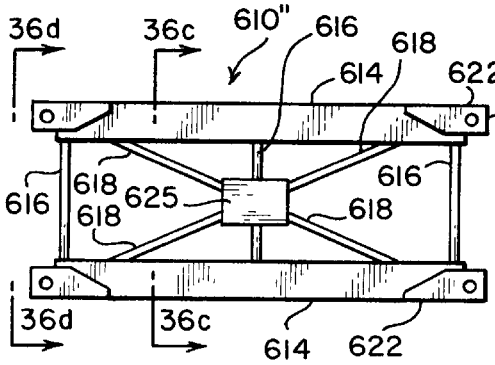
FIG. 36*b* shows an elevation view of a three-foot long version of the beam element of FIG. 36*a*.
Figure 36C:
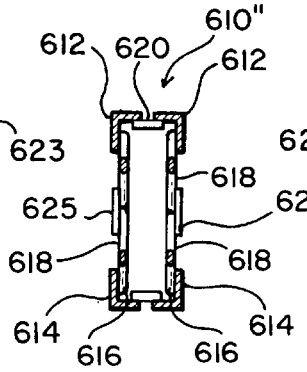
FIG. 36*c* shows a sectional view taken along line 36*c*—36*c* of FIG. 36*b*.
Figure 36D:
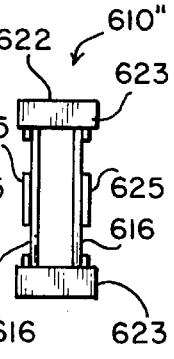
FIG. 36*d* shows a view taken along line 36*d*—36*d* of FIG. 36*b*.
Figure 35B:
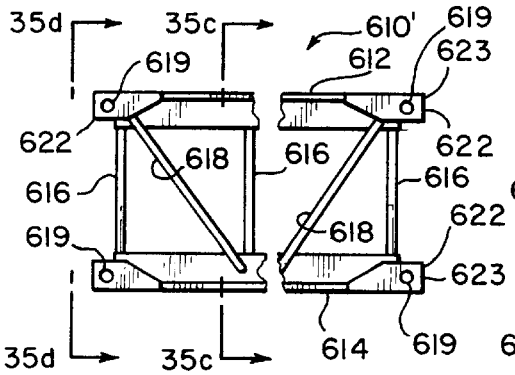
FIG. 35*b* shows an elevation view of a modified beam element of the invention.
Figure 35C:
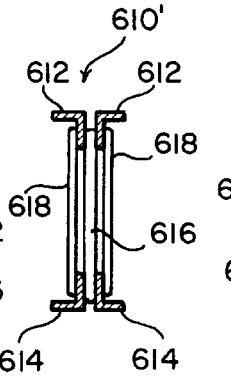
FIG. 35*c* shows a sectional view taken along line 35*c*—35*c* of FIG. 35*b*.
Figure 35D:
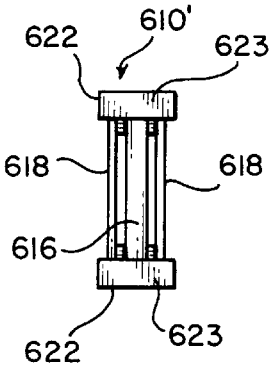
FIG. 35*d* shows a view taken along line 35*d*—35*d* of FIG. 35*b*.

FIGS. 31–33 demonstrate how the various combinations of the above described components may be employed for additional desired uses. FIGS. 31 and 32 show posts which may be used for purposes similar to post 510 shown in FIG. 28, with the exception that building elements are added at the top of the posts instead of at the bottom. FIG. 33 demonstrate how the screw and cap assembly 150 may be placed at the top of a post to be used for preloading a post when a post is being used as a shore. In light of the foregoing discussion, these structures are believed to require no further explanation. Of course, other combinations that will be apparent to one skilled in the art.

Thus, the lifting and shoring system of the present invention has a number of advantages over the prior art. The system provides an apparatus and method for constructing elongate unitary post structures for shoring and lifting. The plumbness of the posts may be accurately controlled by adjusting the nuts 195 on studs 193 at the knuckle joint base. The system allows braces to be installed, thus permitting the load to be lifted to any desired height. The building elements are dimensionally stable, with no uncontrolled movement due to swelling or shrinking. The building elements may be pre-tested to ensure that they are safe to use. The posts have small foot prints and can be used in confined areas. When properly maintained, the building elements can be used over and over for different jobs. Also, the building elements are light enough that a single person can lift them, eliminating the need for hoisting equipment for beams or the like.

System for Elevating a Structure

One particularly advantageous use for the above-described lifting and shoring system is for elevating, supporting, or lowering houses or other structures. Thus, under an additional system of the invention, a plurality of releasably connectable, relatively light-weight beam elements or panels 610 are provided, as illustrated in FIGS. 34*a*–34*e*. Each beam element 610 is a space-frame-like member constructed from structural components, and includes at least one elongate upper main structural component 612, and at least one elongate lower main structural component 614. In the preferred embodiment illustrated, two adjacent, parallel, spaced upper main structural components 612 and two adjacent, parallel, spaced lower structural components 614 are used. Upper structural components 612 and lower structural components 614 are rigidly connected to each other in a spaced relationship, such as by welding, by a plurality of vertical support components 616 so as to form beam element 610. One or more diagonal support components 618 may also be included for diagonally spanning the open spaces between the plurality of vertical support components 616 to increase the strength of beam element 610.

Upper and lower main structural components 612 and 614 are preferably constructed of elongate stock steel bars having a right-angle cross section. These angle bars may be arranged with the angle legs out, as illustrated in FIGS. 34*a*–*e*, or with the angle legs in, as illustrated in beam element 610' in FIGS. 35*a*–*d*. In addition, a variety of other configurations for beam elements 610 may be constructed, as illustrated by beam element embodiment 610" of FIGS. 36*a*–36*d*, wherein diagonal support components 618 have one end connected to a centrally-located plate 625 and the other end connected to one of upper or lower main structural components 612, 614. Since beam elements 610' and 610" are interchangeable with, and very similar to, beam elements 610 of FIGS. 34*a*–*e*, the remainder of the disclosure will refer to all illustrated embodiments 610, 610', and 610" as "beam elements 610" for simplicity. In addition, it will be apparent that a variety of other structural shapes may be used as upper and lower main structural components 612, 614. For example, box-beams, I-beams or other suitable shapes may be used instead of angle bars.

Vertical support components 616 and diagonal support components 618 may be constructed from steel bar stock, and may be welded or otherwise fastened at each end to upper and lower main structural components 612, 614. In addition, one or more horizontal support components 620 may be welded or otherwise attached between adjacent upper and lower main structural components 612, 614 to further strengthen beam element 610, and so as to maintain a slotted space 621 between adjacent upper main structural components 612 and adjacent lower main structural components 614. It is desirable to leave slotted space 621 between adjacent main structural components 612, 614 to facilitate the attachment of beam elements 610 to one another or to a structure or other components of the invention during use, as will be described below. Furthermore, each upper and lower structural component 612, 614 may include a flanged end 622. Pin-receiving holes 619 are formed through flanged ends 622 and upper and lower structural components 612, 614. Flanged ends 622 provide increased bearing strength to pin-receiving holes 619. Flanged ends 622 are further formed so as to provide a flat mating surface 623 on the ends of beam elements 610, so that a first beam element 610 may be placed end-to-end with a second beam element 610 releaseably connected.

One or more connector members 624 are included for connecting the flanged end 622 of a first beam element 610 to the flanged end 622 of a second beam element 610. Connector member 624 is preferably a connector plate 626 having connecting holes 628 formed therein, as illustrated in FIG. 34*f*. When two beam elements are aligned end-to-end, as illustrated in FIG. 34*a*, a connector member 624 may be placed such that a portion of plate 626 overlaps a portion of the adjacent flanged ends 622 of beam elements 610 so that connecting holes 628 align with pin holes 619. Connecting pins 630 may then be inserted through holes 619, 628 for releasably connecting the two beam elements 610 in a secure end-to-end fashion for forming a single unitary consolidated beam. Other suitable fasteners, such as bolts may be used in place of connecting pins 630 if desired, and alternate connecting means will also be apparent to those skilled in the art. In addition, prestress wedges 632 may be provided for preloading the joint between two connected beam elements 610. Prestress wedges 632 are inserted between the adjacent mating faces 623 of adjacent end-to-end beam elements 610 to take up any looseness in the connection and to make the connection rigid.

Beam elements 610 may be provided in a variety of lengths to increase the adaptability of the system of the invention. For example, the preferred embodiment of the invention includes beam elements 610 in four-foot, three-foot, and two-foot lengths, although other lengths may also be provided, such as, for example, between one and six feet in length. It is desirable that beam elements 610 be sufficiently lightweight so that they may be hand-carried by one or two workers for both installation and removal. Thus, as with the other components of the invention, as described above, beam elements 610 may alternatively be made of materials such as aluminum, or composite materials, such as fiberglass, for various applications.

According to the method of the invention, as illustrated in FIGS. 37–40, for raising a structure 640, such as a house, building, or the like, a plurality of beam elements 610 are connected within structure 640 in an end-to-end fashion, as described above, so as to form a plurality of consolidated cross beams 642. Consolidated cross beams 642 are arranged in a spaced, parallel relationship with respect to each other within structure 640 so that each consolidated cross beam 642 is in a position to bear a portion of the load when structure 640 is elevated. For concrete slab structures, a four foot spacing for consolidated cross beams 642 has been found to usually be appropriate. Other spacings may be appropriate for different kinds of structures.

Figure 41:
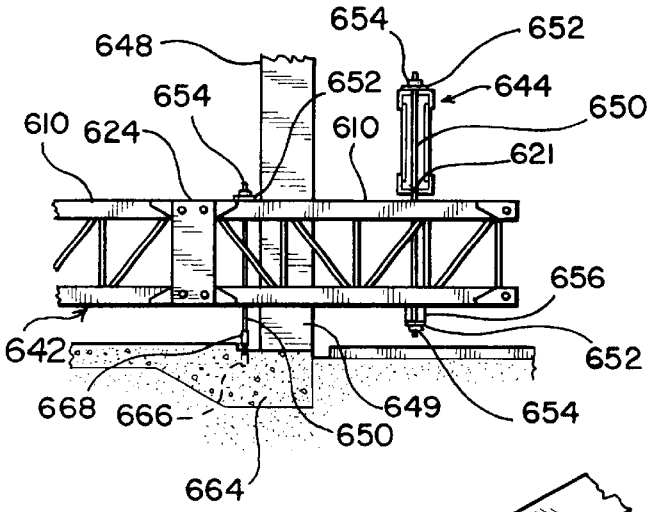
FIG. 41 shows a detail taken along line 41—41 of FIG. 38.

Two additional consolidated cross beams 642 are constructed on the exterior of structure 640 along side walls 645. In addition, a plurality of consolidated jacking beams 644, also constructed from a plurality of connected beam elements 610, are constructed transversely in relation to the plurality of parallel consolidated cross beams 642 so that a grid-like pattern of consolidated beams 642, 644 is formed. In the particular example illustrated, one transverse jacking beam 644 is disposed within structure 640, and passes over top of consolidated cross beams 642. A long transverse consolidated jacking beam 644 is located on the exterior of structure 640, adjacent to the rear wall 646, and three shorter transverse consolidated jacking beams 644 are located on the exterior of structure 640, adjacent to the front walls 648. Consolidated jacking beams 644 are structurally connected to consolidated cross beams 642, as described below in more detail, so as to form a lifting grid for supporting and elevating structure 640.

Where possible, consolidated beams 642, 644 pass straight through doorways or windows 649, so that the ends extend outward to the exterior of structure 640, as also illustrated in FIG. 41. Thus, these consolidated beams 642, 644 installed on the interior of structure 640 pass to the exterior of structure 640 and are directly coupled to respective consolidated beams 642, 644, located on the exterior of structure 640. Attachment between perpendicular consolidated beams 642, 644 is accomplished using a threaded rod 650, washers 652, nuts 654, and may include a slotted support bar 656 located under the lower of the two consolidated beams 642, 644 being connected, as illustrated in FIG. 41.

Slotted support bars 656 may be provided in various lengths, as illustrated in FIG. 42, and are comprised of two bars 658 having generally C-shaped cross sections disposed in opposition to each other, and welded together with spacers 660 so that a longitudinal slot 662 is formed between bars 658. As illustrated in FIG. 41, for coupling two consolidated beams 642, 644 to each other, a threaded rod 650 is passed through slotted areas 621 in consolidated beams 642, 644, and also through longitudinal slot 662 in slotted support bar 656. Nuts 654 and washers 652 are then placed on threaded rod 650 to hold beams 642, 644 and slotted support bar 656 together in a coupled condition. Furthermore, it should be noted that threaded rods 650 generally act as tenons and are not intended to support substantial compression loads.

Consolidated cross beams 642 are also attached to the floor of structure 640 for supporting structure 640 during lifting. For structures having a concrete slab floor 664, holes are drilled in floor 664 at four-foot intervals, and anchor or expansion nuts 666 are inserted into these holes. Threaded rods 650 are then passed through slotted spaces 621 in beam elements 610, and connected to expansion nuts 666 using a threaded sleeve 668, as also illustrated in FIG. 43. A nut 654 and washer 652 is used on top of consolidated cross beam 642 to secure threaded rod 650 in place. In addition, it should be noted that it is desirable to have consolidated cross beams 642 secured to floor 664 at a distance spaced somewhat above floor 664 so that where it is necessary to pass through interior walls of structure 640, minimal damage is done, and it is not necessary to cut baseboards, floor joists or the like. Wooden blocks or the like (not shown) may be used to support consolidated beams 642 above floor 664 prior to lifting.

Figure 44:
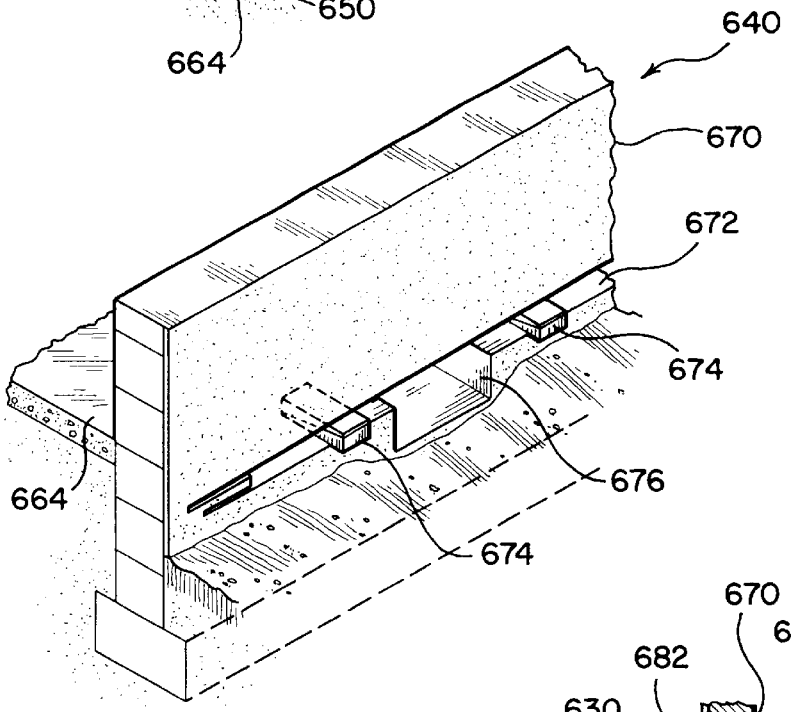
FIG. 44 shows a detail of an external wall of the structure undergoing preparation for installation of the apparatus of the invention.

As illustrated in FIG. 44, the exterior walls 670 (collectively, side walls 645, rear wall 646 and front walls 648) of a structure such as structure 640 often extend into the ground below the slab floor 664. Thus, before a structure can be elevated, the structure usually must be separated from that portion of the walls 670 which extend below the slab floor 664. This may be accomplished by using a saw having a diamond cutting blade, or other suitable device, to cut a separating slot 672 around the perimeter of the structure through the exterior walls 670 approximately eight inches below floor 664. In order to form separating slot 672, two parallel cuts are made, and the material between the cuts is removed. Oak wedges 674 are placed within separating slot 672 to maintain the position of exterior wall 670 and structure 640.

In addition, it is desirable to avoid passing consolidated beams 642, 644 through exterior walls 670 of structure 640 at a location above floor 664, as this can cause considerable damage to exterior walls 670 in locations of the structure where it is desirable to preserve walls 670. Accordingly, to avoid this damage, the system of the invention includes a method of passing supporting equipment through the floor 664, and then out to the exterior of the structure. To accommodate this, step downs 676 are formed in exterior wall 670 at locations in line with consolidated cross beams 642. Step downs 676 allow the soil under floor 664 to be removed at these locations.

Figure 45:
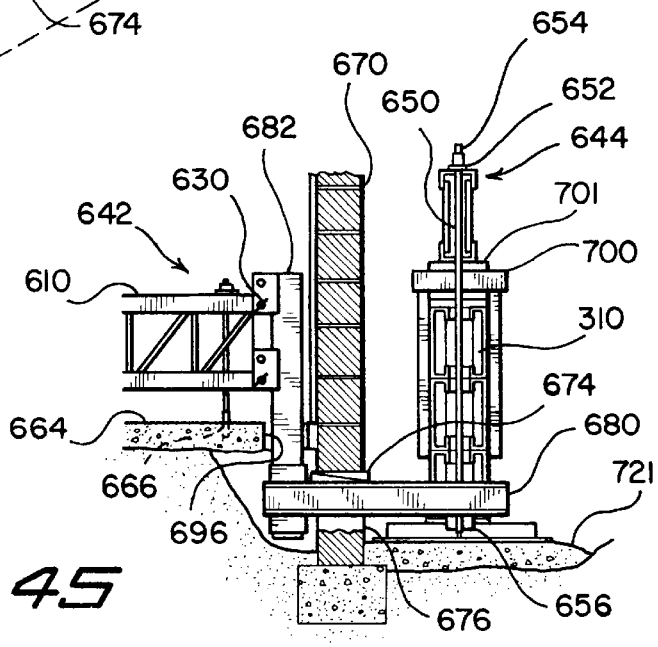
FIG. 45 shows a detail taken along line 45—45 of FIG. 38, showing installation of the drop beam and drop post of the invention.

As illustrated in FIGS. 45–47, step downs 676 allow access for placement of a drop beam 680 and a drop post 682 which are provided for connecting consolidated cross beams 642 to an exterior lifting apparatus, without having to pass consolidated cross beams 642 through the exterior walls 670 of structure 640. Drop post 682 is a structural post member constructed from a length of steel box beam stock 686, and includes connecting lugs 684 welded to its upper end. Connecting lugs 684 include pin holes 688 which are positioned so as to align with pin-receiving holes 619 formed in beam element 610. Thus, the upper end of drop post 682 may be releasably mated to the flanged end 622 of consolidated cross beam 642 by pin holes 688 using pins 630. Several sets of pin holes 688 may be provided in connecting lugs 684 for ease of aligning drop post 682 with flanged end 622 of consolidated cross beam 642. The lower end of drop post 682 has two sets of plates 690 mounted thereon for forming mating slots 691 on opposite sides of drop post 682. Mating slots 691 are of a proper width for receiving and retaining drop beam 680 by sliding drop beam 680 perpendicularly onto drop post 682 in a mating relationship.

Drop beam 680 is a structural beam member constructed from a pair of spaced, parallel, stock steel channel bar members 692 having a generally C-shaped cross section. Channel members 692 are held in a spaced relationship by plate spacers 693, which are welded to the tops and bottoms of channel members 692. Reinforcing gussets 694 may also be welded to channel members 692 as reinforcement. The spacing and height of channel members 692 is corresponded to the size of mating slots 691 on drop post 682, so that drop beam 680 is able to engage with drop post 682 generally perpendicularly at a generally right angle, and transfer a load therebetween in a cantilevered fashion without slipping off.

To install drop beam 680 and drop post 682, a hole 696 is formed in floor 664 inside structure 640 near to exterior wall 670, and soil is removed from the area between hole 696 and step down 676. Drop post 682 is placed in hole 696 and connected generally at a right angle to the end of consolidated cross beam 642 by aligning pin holes 688 in connecting lugs 684 with connecting holes 619 in flanged end 622 of beam element 610, and placing connecting pins 630 through the aligned holes 688, 619. Drop beam 680 is then slid through step down 676, and engaged with mating slots 691 on the lower end of drop post 682. The free end of drop beam 680 may be connected to one of consolidated jacking beams 644 or otherwise connected to a lifting or jacking device. Thus, in this manner, a structural communication is formed between consolidated cross beams 642 on the interior of structure 640 and the exposed end of drop beam 680 on the exterior of structure 640, and thus to the lifting system, without having to damage the portions of exterior walls 670 which are to be preserved on structure 640.

As illustrated in FIGS. 45 and 47, drop beams 680 are connected to the vertical support and lifting system of the invention by connecting to one of transverse consolidated jacking beams 644. Threaded rods 650 are inserted through slotted spaces 621 on beam elements 610, through drop beam 680, and fastened to slotted support bars 656 using nuts 654 and washers 654. In addition, it may be seen that wedges 674 may be inserted between drop beam 680 and the wall 670 of structure 640 to take up any clearance so as to avoid placing excessive bending stresses on the connection of drop beam 680 and drop post 682, and to provide bearing support to exterior walls 670 of structure 640.

Consolidated beams 642, 644 located on the exterior of structure 640 are mounted on the support and lifting system of the invention, as described above in FIGS. 1–33. FIGS. 45 and 47 show consolidated jacking beam 644 mounted on a lifting device, such as a lifting post 310, set forth and described in FIGS. 14*b*, 21*a*–21*e*, and 22–24 above. A stabilizer yoke 700 is placed between load transfer bar 250 and jacking beam 644 to provide a connection point for connecting jacking beam 644. Also wooden blocks 701 may be placed between stabilizer yoke 700 and jacking beam 644 for use as a bearing surface, as illustrated in FIG. 45, but are not required. As illustrated in FIG. 48, stabilizer yoke 700 includes a pair of horizontal channel members 702 connected to the ends of two rectangular tubes 704. Channel members 702 are spaced from each other to create a connecting slot 706 for connecting stabilizer yoke 700 to jacking beam 644 using a threaded rod 650, nuts 654 and washers 652, in the manner described above with respect to other elements of the invention. Rectangular tubes 704 are spaced from each other so as to be able to receive load transfer bar 250 under horizontal channel members 702. Stabilizer yoke 700 rests on load transfer bar 250, and rectangular tubes 704 extend downward along the sides of building elements 120. Load transfer bar 250 is supported by a hydraulic cylinder 330 and shelf member 332, as described above. Accordingly, it may be seen that, through threaded rods 650, drop beams 680, drop posts 682, and consolidated cross beams 642, jacking beam 644 is connected structurally to structure 640, so that as jacking beam 644 is raised by actuating cylinders 330, structure 640 will also be raised. By coordinating the simultaneous actuation of a plurality of cylinders 330 within lifting posts 310, as will be described below in more detail, structures of practically any size may be raised using the system of the invention.

Figure 38:
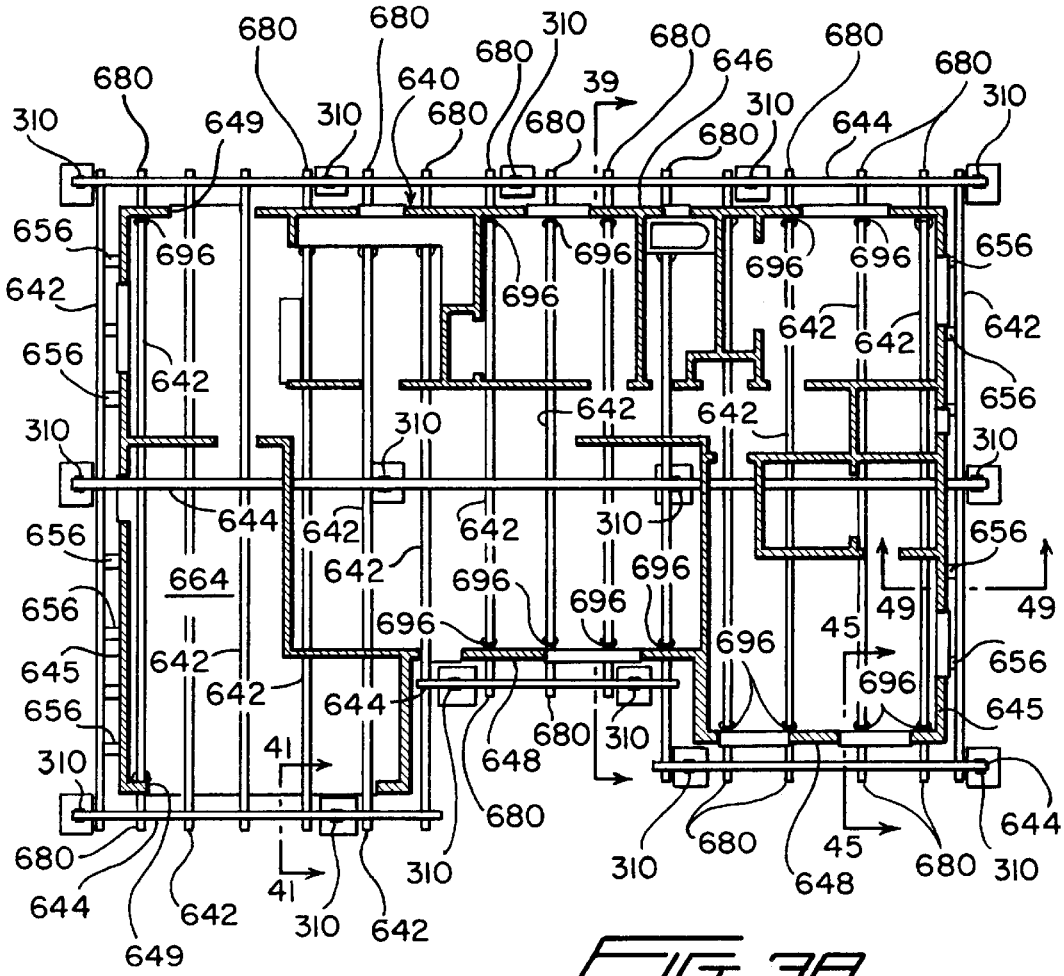
FIG. 38 shows a plan view of the structure of FIG. 37.

To provide additional support for side walls 645 during lifting, a plurality of slotted support bars 656 may be installed under side walls 645, as illustrated in FIGS. 38 and 49. These additional supports are provided in a plurality of locations (preferably every four feet) along side walls 645 so that side walls 645 are supported during lifting to prevent sagging or other structural damage. To accommodate support bars 656, step downs 676 are formed in side walls 645, as described above, and the soil is excavated. Prior to installation of the consolidated cross beams 642 located nearest to side walls 645, holes 710 are formed in floor 664 near side walls 645 in predetermined locations adjacent to the locations of step downs 676, so as to be directly under the consolidated cross beams 642. Threaded rods 650, nuts 645 and washers 652 are then used to connect the consolidated cross beam 642 inside structure 640 to slotted support bar 656, and also to connect consolidated cross beam 642 on the exterior of structure 640 to slotted bar 656. In addition, oak wedges 674 or a wooden block may be placed between slotted bar 656 and the bottom of side wall 645 as a bearing surface.

Figure 50A:
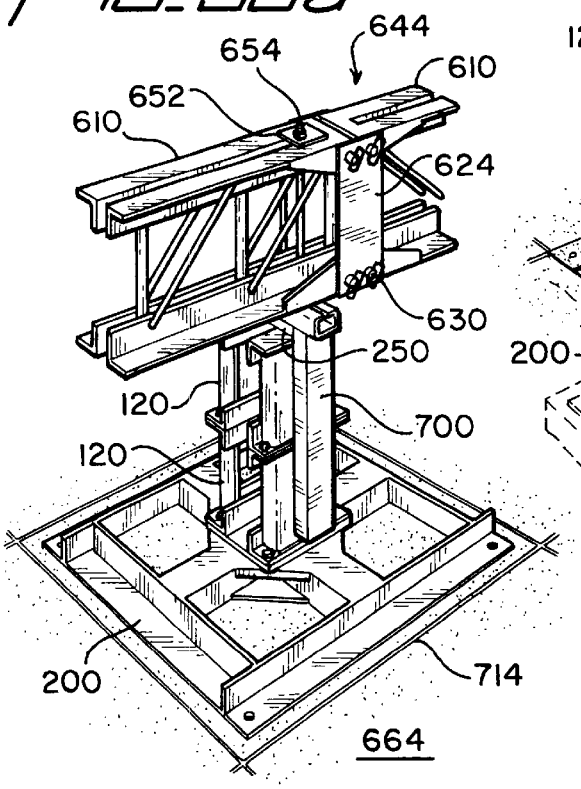
FIG. 50*a* shows a perspective view of a lifting post and consolidated jacking beam located on the interior of the structure.
Figure 50B:
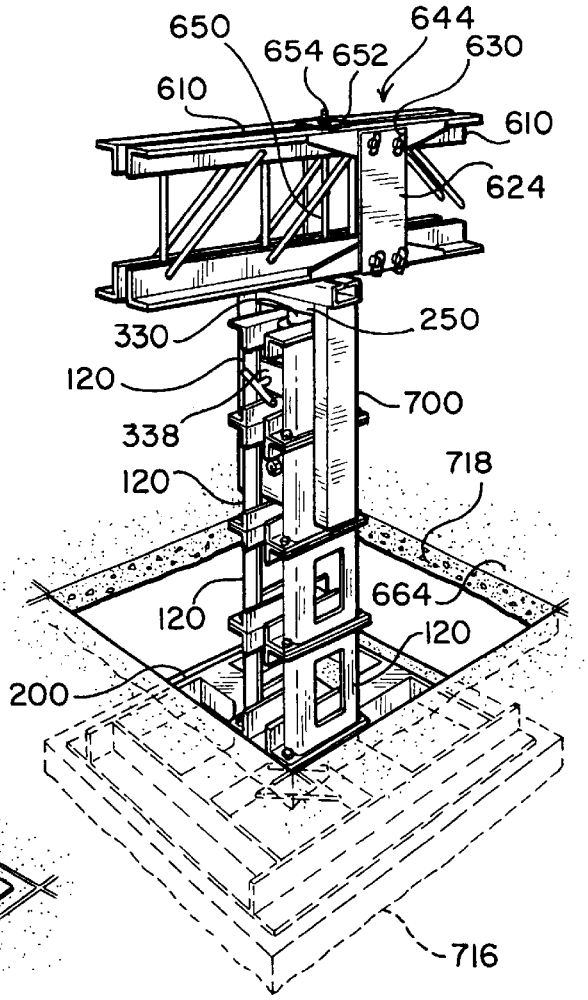
FIG. 50*b* shows the view of FIG. 50*a* during the lifting process.

FIGS. 50*a* and 50*b* show a perspective view of a lifting device, such as a lifting post 310 set up inside structure 640. Generally if a structure is less than 30 feet wide from front wall 648 to rear wall 646, then it is not usually necessary to place lifting posts 310 inside structure 640, and transverse consolidated jacking beam 644 may also be eliminated from inside the structure. However, in structures having a width greater than 30 feet, it is recommended to include one or more additional lifting devices inside the structure so that the unsupported span of consolidated cross beams 642 is not too great. To enable placement of lifting posts 310 in structure 640, a portion of floor 664 must be cut out and remain on the foundation while the remainder of structure 640 is elevated. Thus, one or more lifting posts 310 are connected to consolidated jacking beam 644 in predetermined locations within structure 640, with the number of lifting posts 310 and the appropriate locations for placement being dependent on the size, weight, and shape of the specific structure 640. As illustrated in FIG. 50*a*, a diamond-bladed saw (not shown) is first used to make a cut 714 completely through floor 664 around the perimeter of all terrain base 200, or which ever base of the invention, as set forth above, is to be used. Then, as structure 640 is progressively elevated, floor 664 rises around lifting post 310, while the cut-out portion 716 of floor 664 remains in place underneath all terrain base 200. The hole 718 in floor 664 caused by removal of cut-out portion 716 is doweled and filled in after lifting is complete and lifting post 310 has been removed.

Figure 51A:
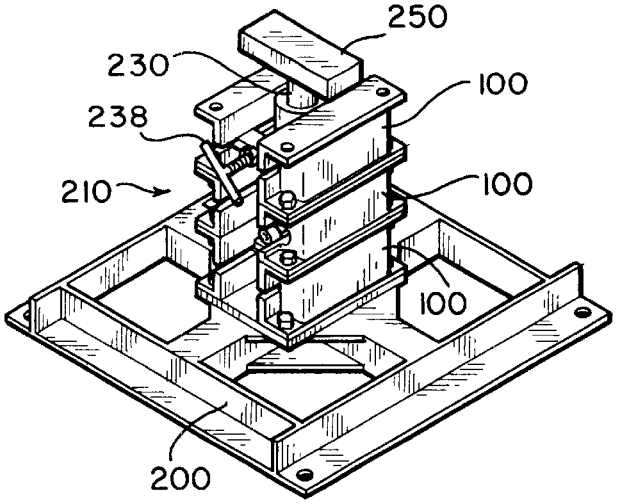
FIG. 51*a* shows an alternate lifting post of the invention.
Figure 51B:
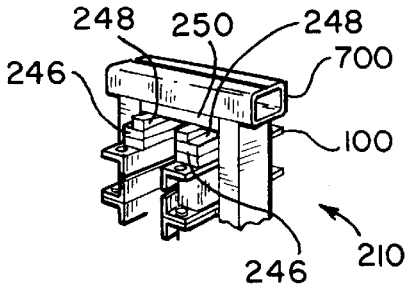
FIG. 51*b* shows the lifting post of FIG. 51*a* with the stabilizer yoke, shims, and wedges installed.

FIGS. 51*a* and 51*b* illustrate post 210 of the invention, as described above, mounted on an all terrain base 200, and in use with a stabilizer yoke 700. Post 210 or portions thereof, or other parts of the lifting and shoring system described above, may be substituted interchangeably for lifting post 310 in any of the applications shown with the only difference being that the height of the building elements 100 is less than the height of building elements 120, so that a lower starting height for a lift is possible. Generally, a sufficient number of lifting devices, such as lifting posts 310, 210 are used so that the average anticipated lifting force per lifting post is 7 to 10 tons. In addition, it may be noted that other conventional lifting devices may also be used with the beam elements 610 and lifting grid of the invention, but these would in all likelihood require special equipment or installation procedures, excavation, destruction of landscaping, and the like.

Under the method of the invention for elevating structure 640, first, the exterior walls 670 are cut approximately eight inches below the floor level, as illustrated in FIG. 44. Next, a plurality of holes 696 are cut in floor 664 where it will be necessary to install drop posts 682 and drop beams 680, and a second plurality of holes 710 are cut in floor 664 along side walls 645 where it will be necessary to support side walls 645. The bases for lifting posts 310 are then installed in predetermined locations. The type of bases used depends on the surface, but typically will be all terrain bases 200 which are placed on a six-inch thick layer of gravel 721 on the exterior of structure 640, or on floor 664 within structure 640. Cuts 714 are made in floor 664 around any bases 200 which are located on the interior of structure 640. Step downs 676 are then formed in exterior walls 670 in locations adjacent to holes 696, 710 in floor 664, and the soil or other material underneath floor 664 is hand excavated in this locations. A plurality of parallel consolidated cross beams 642 are installed within structure 640 and fastened to floor 664 as described above. Drop beams 680 and drop posts 682 are installed through holes 696 and stepdowns 676, and connected to consolidated cross beams 642. Additional consolidated cross beams 642 are constructed along side walls 645 on the exterior of structure 640. Slotted support bars 656 are installed along side walls 645 and connected to cross beams 642 inside and outside of structure 640.

Figure 37:
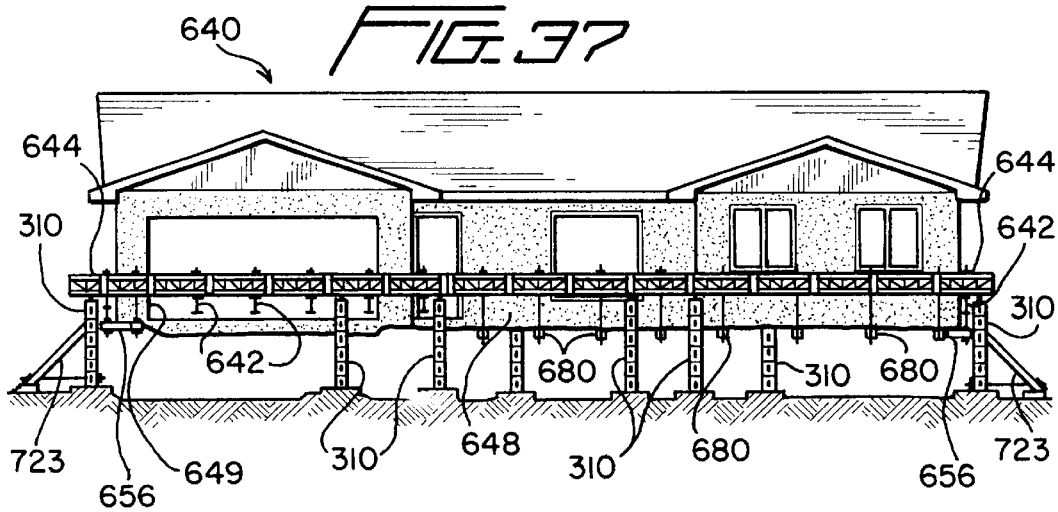
FIG. 37 shows an elevation view of a structure being elevated using the apparatus and method of the invention.

Next, lifting posts 310 are positioned on bases 200, with the number of building elements 120 initially placed being dependent on the height of building elements 120, the length of threaded rods 650 to be used as connecting fasteners, and the like. In the embodiment shown, typically three building elements 120 are initially installed. Transverse consolidated jacking beams 644 are then constructed perpendicularly to cross beams 642, and connected to cross beams 642, as described above, and also connected to lifting posts 310. Accordingly, a structural communication is formed between hydraulic cylinders 330 on lifting posts 310 and structure 640 so that cylinders 330 may be activated to raise structure 640. All connections are checked for tightness, and pressure is applied to cylinders 330 to pretension the pin, nut, rod, and beam connections, but the initial pressure applied at this point is insufficient to actually lift the structure. Wedges 632 and 674 are tightened where necessary. Cylinders 330 are then extended one half inch and the connections and wedges are again checked for tightness. This process is repeated until structure 640 is fully supported by lifting posts 310. Lifting of structure 640 may then be performed as described above, by progressively extending cylinders 330, placing additional building elements 120 in the new space created by extending cylinders 330, and moving cylinders 330 up post 310 to a new position for further lifting. Structure 640 may be elevated or lowered to practically any height with proper lateral support of lifting posts 310. For example, side braces 723 may be used to provide lateral support to lifting post 310, as illustrated in FIG. 37, but deleted from the other Figures.

Figure 52:
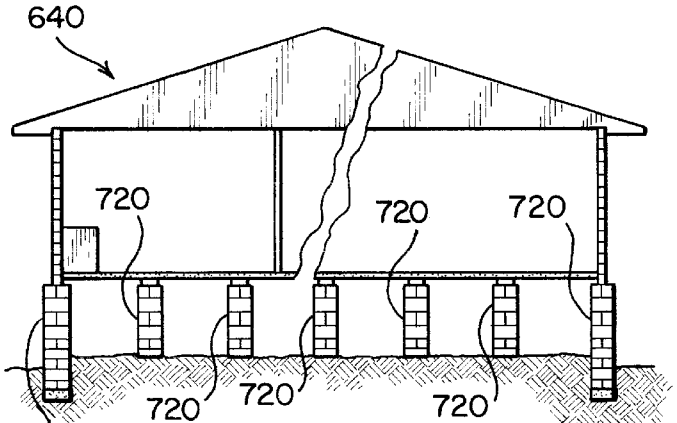
FIG. 52 shows a structure following lifting supported by a temporary support structure.

Once structure 640 has been elevated to the desired height, a temporary support system may be built under structure 640 so that the building elements, beam elements, and other components of the invention may be removed and used on subsequent projects, if desired. Thus, as illustrated in FIG. 52, floor 664 and walls 670 may be supported by constructing 16-inch-square piers 720 of dry-stacked concrete blocks. These piers 720 are typically spaced 4–5 feet apart, and the space above the piers may be filled with oak shims or wedges 674, or fast-setting cement mortar may be used. The space under floor 664 is preferably five feet or higher so that the space is useful for storage, and it is easier for workers to work under the structure 640. Of course, structure 640 may be elevated to a full story in height or more, in which case the temporary piers 720 should be properly braced against wind loads. A permanent support structure (not shown) is then built under structure 640 in accordance with the intended purpose and desired use of structure 640. Such permanent support structures may include permanent concrete piers, steel and/or concrete support pylons, extension of the walls to the ground, etc.

Figure 53:
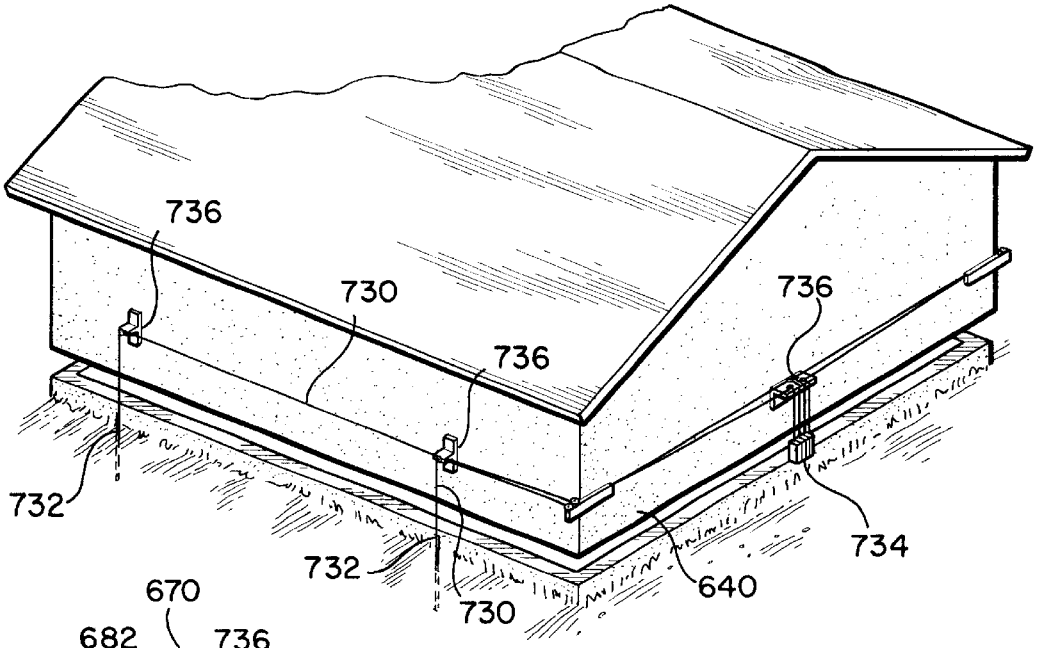
FIG. 53 shows a perspective view of a structure having a lifting-synchronization system installed for use with the lifting system of the invention.
Figure 54:
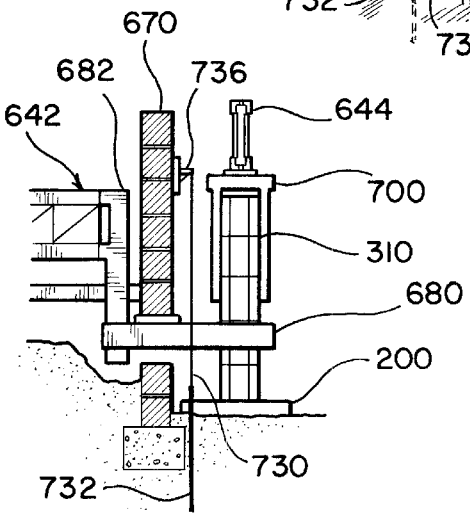
FIG. 54 shows an elevation view of the lifting-synchronization system installed with the lifting system of the invention.
Figure 55:
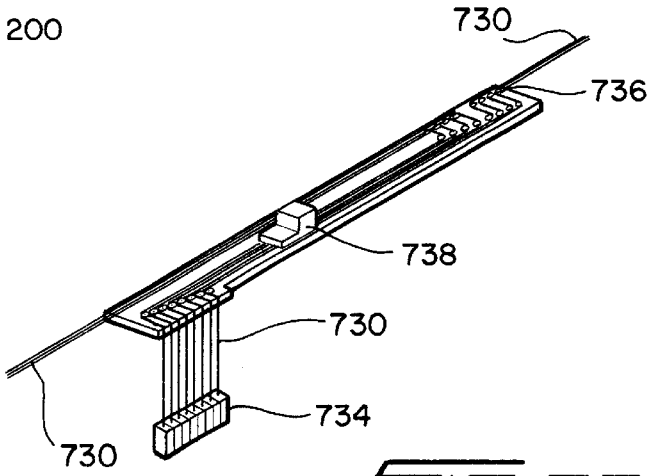
FIG. 55 shows the automated version of the lifting-synchronization system for use with the lifting system the invention.

In addition, as mentioned above, when lifting is in progress, a synchronization system is used to monitor the raising of structure 640 to ensure that lifting at all lifting posts 310 is performed evenly. FIGS. 53–55 illustrate a monitoring and synchronization system which may be used with the present invention, and which is set forth in greater detail in U.S. Pat. Nos. 4,251,974 and 4,832,315, to the same inventor as herein, and the disclosures of which have been incorporated herein by reference. Briefly, the synchronization system includes a plurality of stainless steel control tapes 730 which are attached to stakes 732 on one end, and which have weights 734 attached to the other end. A series of pulleys 736 are installed around the perimeter of structure 640, and weights 734 are aligned with each other in one location. Each stake 732 is located adjacent to a lifting post 310 (lifting posts 310 and the other equipment of the invention are not shown in FIG. 53 for clarity) so that changes in the distance between a stake 732 in the ground, and a pulley 736 mounted on structure 640 correspond to the distance which structure 640 has been raised at that location. If one area of structure 640 is raised more than the other areas, this will be shown by a misalignment of weights 734. This system may be monitored manually, or may be automated, as shown in FIG. 55, wherein a sensor 738 reads the changes in distance of tapes 730, and automatically controls the hydraulic pumps (not shown) which deliver hydraulic fluid to cylinders 330.

Figure 56B:
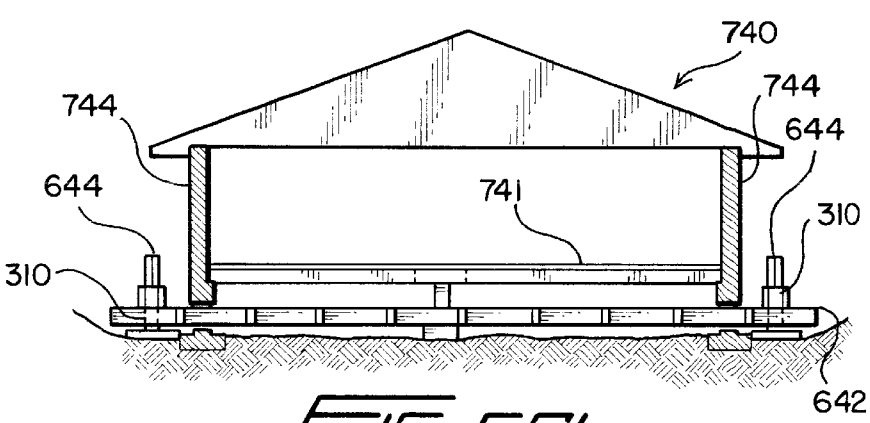
FIG. 56*b* shows the embodiment of FIG. 56*a* with the consolidated beams fully installed.
Figure 56C:
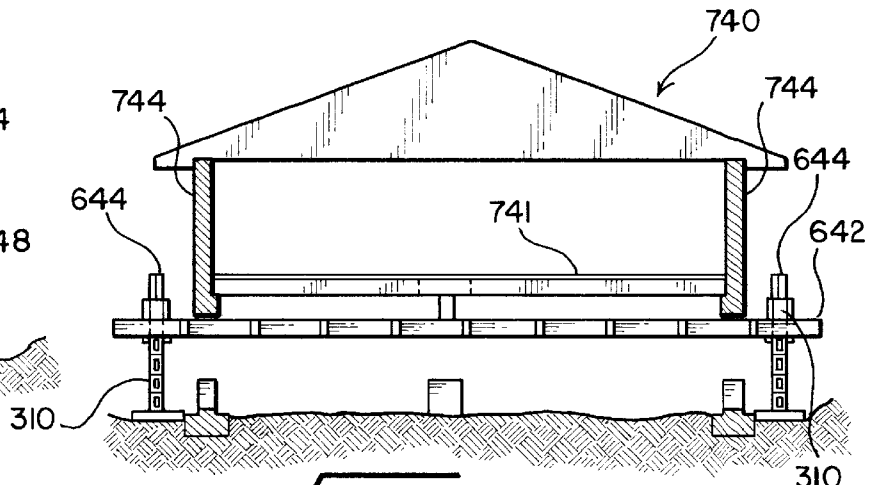
FIG. 56*c* shows the embodiment of FIG. 56*a* during lifting of the structure.
Figure 56A:
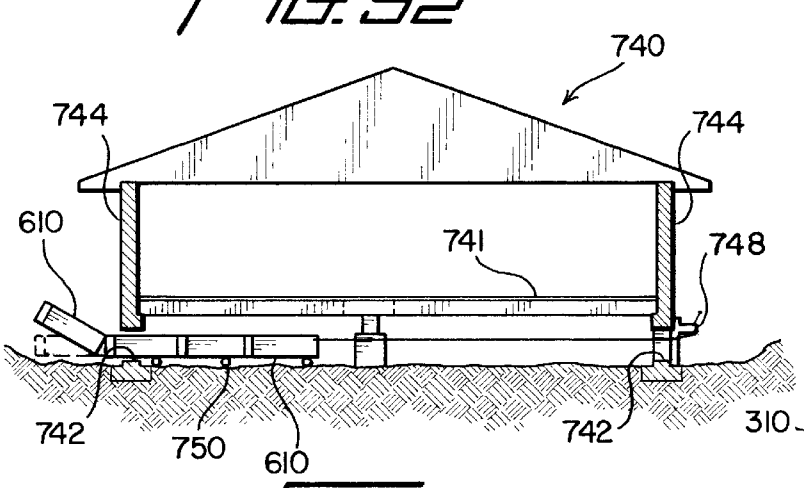
FIG. 56*a* shows an alternative method of use of the system of the invention during initial installation of the consolidated beams.

Alternative uses for the apparatus of the invention are also possible, and several of these will be set forth herein. For example, as illustrated in FIGS. 56*a*–56*c*, a structure 740 having sufficient space under its floor 741 may be elevated by installing beam elements 610 under floor 741, rather than on top. This may be accomplished by cutting holes 742 in side walls 744 of structure 740, and then inserting beam elements 610 progressively until a consolidated cross beam 642 is formed. Beam elements 610 may be connected to each other as they are being inserted under structure 740. If necessary, a winch 748 and roller supports 750 may be used to make insertion of beam elements 610 easier. A plurality of cross beams 642 are inserted under structure 740, spaced typically four feet apart. These cross beams 642 are connected to perpendicularly arranged jacking beams 644, as described above with respect to the previous embodiment. Then following appropriate pre-stressing and pre-loading of the equipment, structure 740 may be raised according to the method set forth above.

FIGS. 57*a*–57*b* show an arrangement useful for elevating wood frame houses. In this arrangement, beam elements 610 are inserted under a structure 760, either in the manner described above with respect to FIG. 56*a*, or by assembling beam elements together under structure 760. A plurality of parallel consolidated cross beams 642 are formed under structure 760. Drop posts 682 and drop beams 680 are connected to the ends of consolidated cross beams 642, but in a condition upside down relative to that disclosed above. Lifting posts 310 are located under drop beams 680, and may be used to raise structure 760. Structure 760 is severed from its foundation prior to raising either before or following installation of cross beams 642 and lifting posts 310. Of course, jacking beams 644 may also be used with this configuration, as described above, if desired.

From the foregoing, it will be apparent that the present invention sets forth a novel method and apparatus for relocating a structure, such as a building from a first elevation to a second elevation. A plurality of beam elements are provided by the invention and the beam elements are releasably connectable to each other in an endwise fashion so that they may be assembled to each other within the interior of the structure so as to form a desired number of spaced consolidated beams. The beam elements are light enough (i.e., typically less than 40 pounds), and short enough (i.e., between one and six feet in length) so that they may be carried by hand by one or two workers, so that no additional lifting equipment, such as hoists, cranes, or forklifts, are required to use the system of the invention.

The beam elements may be assembled to form consolidated beams which are attached to the structure by fastening devices. The consolidated beams are also assembled so as to be in structural communication with the lifting devices of the invention, such as a lifting post 210, 310, which is capable of progressively elevating or lowering the structure. The lifting devices are typically located on the exterior of the structure, but also may be located on the interior of the structure to when it is necessary to span larger size structures. The lifting devices are operable by hydraulic pressure to move the structure from a first elevation to a second elevation. A synchronization system may also be used so as to ensure that the building remains level during movement. Thus, it is evident that the system of the invention provides a number of advantages over the prior art such as in ease of installation and removal of the components, adaptability of the components to different configurations to accommodate a variety of different lifting tasks, and the durability and reusability of the components.

Accordingly, while preferred embodiments of a method and apparatus for a modular support and lifting system in accordance with the present invention have been set forth fully and completely herein, it will be apparent to one of skill in the art that a number of changes in, for example, the sizes and shapes of the various components, the materials used, the configurations constructed, the types of structures to be relocated, and the like can be made without departing from the true spirit and scope of the present invention, which is to be limited only by the following claims.

What is claimed is:

1. A method for relocating a structure from a first elevation to a second elevation, said method comprising:

providing a plurality of beam elements, said beam elements being releasably connectable to each other in an endwise fashion;

assembling a plurality of said beam elements to each other within the interior of the structure to form a plurality of spaced consolidated beams;

attaching at least some of said consolidated beams to the structure;

attaching at least some of said consolidated beams to a plurality of lifting devices located on the exterior of the structure; and using said lifting devices to move the structure from a first elevation to a second elevation.

2. The method of claim 1 further including the step of attaching at least some of said consolidated beams to one or more lifting devices located inside the structure.

3. The method of claim 1 wherein the step of assembling said beam elements to each other within the interior of the structure to form a plurality of spaced consolidated beams includes the step of forming a plurality of spaced generally parallel consolidated cross beams within the structure.

4. The method of claim 3 further including assembling a plurality of said beam elements to form at least one consolidated jacking beam, and disposing said at least one consolidated jacking beam transversely over said cross beams, said at least one consolidated jacking beam connecting said lifting device to said cross beams.

5. The method of claim 1 further including the step of providing at least one structural post member and at least one structural drop beam member connectable to said at least one structural post member, and wherein the step of attaching at least some of said consodilated beams to said lifting devices incldes the steps of forming a hole through the floor of the structure adjacent to the end of at least one said consolidated beam, attaching one end of said one structural post member to said at least one consolidated beam so that said one structural post member extends through the hole in the floor of the structure, attaching one end of one of said drop beam members to said post member, and placing the other end of said drop beam member in structural communication with one or more of said lifting devices.

6. The method of claim 1 wherein said step of attaching at least some of said consolidated beams to said lifting devices includes the step of assembling a plurality of said beam elements to form at least one jacking beam on the exterior of the structure, said at least one jacking beam being in structural communication with said at least one lifting devices, and placing said consolidated beams located within the structure in structural communication with said jacking beam so that said consolidated beams within said structure are in structural communication with said lifting devices.

7. A method for relocating a structure from a first elevation to a second elevation, said method comprising:

providing a plurality of beam elements capable of being assembled to each other in an end-to-end manner for forming elongate consolidated beams;

assembling some of said plurality of beam elements to form a grid of said consolidated beams;

using a plurality of said consolidated beams to form a plurality of spaced cross beams for attachment to a floor of the structure;

attaching at least some of said consolidated beams to the structure;

attaching said grid of said consolidated beams to a plurality of lifting devices; and using said lifting devices to relocate said grid from a first elevation to a second elevation, whereby the structure is also relocated from a first elevation to a second elevation.

8. The method of claim 7 wherein said step of assembling said beam elements within the structure to form said grid of said plurality of consolidated beams also includes the step of forming at least one jacking beam positioned transversely to said spaced cross beams.

9. The method of claim 7 further including the step of providing at least one structural post member and at least one structural drop beam member connectable to said at least one structureal post member, and wherein the step of attaching said grid of said plurality of said consolidated beams to a plurality of lifting devices includes the steps of forming a hole through the floor of the structure adjacent to the end of at least one said consolidated beams, attaching one end of one said structural post members to said at least one consolidated beam so that said structural post member extends through the hole in the floor of the structure, attaching one end of one of said drop beam members to said structural post member, and placing the other end of said drop beam member in structural communication with one or more of said lifting devices, whereby damage to the exterior walls of the structure is minimized.

10. The method of claim 7 wherein said step of attaching said grid of said consolidated beams to said lifting devices includes the step of assembling a plurality of said beam elements to form at least one jacking beam on the exterior of the structure, said at least one jacking beam being in structural communication with said lifting devices, and placing said consolidated beams in structural communication with said at least one jacking beam so that said consolidated beams are in structural communication with said lifting devices.

11. An apparatus for relocating a structure from a first elevation to a second elevation, said apparatus comprising:

a plurality of beam elements, each said beam element having at least one elongate upper structural component and at least one elongate lower structural component, said at least one upper structural component being rigidly connected to said at least one lower structural component by a plurality of support components, each said beam element being releasably connectable to others of said beam elements in an end-to-end manner for forming at least one consolidated beam;

a plurality of fastening devices for structurally connecting said at least one consolidated beam to the structure; and a plurality of lifting devices in structural communication with said at least one consolidated beam, said lifting devices being configured for moving said at least one consolidated beam and the structure connected to said at least one consolidated beam from a first elevation to a second elevation.

12. The apparatus of claim 11 further including a slotted area in each said beam element for receiving said fastening devices for structurally connecting said beam to the structure.

13. The apparatus of claim 12 wherein said fastening devices include a threaded rod, one end of which is connected to the floor of the structure by an anchor nut and the other end of which is disposed within said slotted area and retained by a washer and nut for fastening said at least one consolidated beam to the structure.

14. The apparatus of claim 11 further including at least one connector member for releasably connecting said beam elements to one another in an end-to-end manner.

15. The apparatus of claim 14 wherein said at least one connector member is a plate having pin holes formed therein and furth4r wherein said beam elements have matching holes formed on each end thereof, whereby said plate may be pinned to two of said beam elements aligned in an end-to-end fashion for forming said a consolidated team.

16. The apparatus of claim 11 further including at least one drop post and at least one drop beam, said at least one drop post being an elongate structural member releasably connectable to one of said plurality of beam elements at approximately a right angle, and said at least one drop beam being an elongate structural member releasably connectable to said drop post at approximately a right angle for forming a structural communication between said at least one consolidated beam inside the structure and a lifting device located outside of the structure.

17. The apparatus of claim 11 wherein each said beam element includes a pair of upper structural components aligned parallel to each other in a spaced relationship so as to form a first space, and a pair of lower structural components aligned parallel to each other in a spaced relationship so as to form a second space, and wherein said first and second spaces form a slotted area for receiving said fastening devices.

18. The apparatus of claim 17 wherein said fastening devices each include a threaded rod, one end of which is connected to the floor of the structure by an anchor nut and the other end of which is disposed within said slotted area and retained by a washer and nut.

19. The apparatus of claim 11 wherein at least some of said plurality of beam elements each comprises a pair of spaced adjacent elongate upper structural components connected to each other by a plurality of horizontal support components, and a pair of spaced adjacent elongate lower structural components connected to each other by a plurality of horizontal support components, said upper structural components being rigidly connected to said lower structural components in a spaced relationship by a plurality of vertical support components.

* * * * *